US010433663B2

(12) United States Patent
Gonterman et al.

(10) Patent No.: US 10,433,663 B2
(45) Date of Patent: Oct. 8, 2019

(54) INTERIOR-FOCUSED SLOPED-SIDED APPARATUS AND METHOD

(71) Applicant: NumNum, LLC, Duluth, GA (US)

(72) Inventors: Doug Gonterman, Duluth, GA (US); Jessica Lineberry, Duluth, GA (US)

(73) Assignee: Numnum LLC, Gulf Breeze, FL (US)

( * ) Notice: Subject to any disclaimer, the term of this patent is extended or adjusted under 35 U.S.C. 154(b) by 638 days.

(21) Appl. No.: 14/807,601

(22) Filed: Jul. 23, 2015

(65) Prior Publication Data

US 2016/0022064 A1 Jan. 28, 2016

Related U.S. Application Data

(60) Provisional application No. 62/027,990, filed on Jul. 23, 2014.

(51) Int. Cl.
*A47G 19/02* (2006.01)

(52) U.S. Cl.
CPC ..... *A47G 19/02* (2013.01)

(58) Field of Classification Search
CPC .... A47G 19/02; A47G 19/10; A47G 2400/06; A47G 2400/068
USPC ..... 220/574, 574.1
See application file for complete search history.

(56) References Cited

U.S. PATENT DOCUMENTS

| | | | | |
|---|---|---|---|---|
| 2,683,974 A | | 7/1954 | Brown | |
| D180,329 S | * | 5/1957 | Highberger | 220/574 |
| 3,722,476 A | * | 3/1973 | Van Ness | A01K 5/0114 119/61.54 |
| 5,542,565 A | * | 8/1996 | Hidalgo-Lopez | A47G 19/02 220/574 |
| 7,637,388 B2 | * | 12/2009 | Schantz | A47G 19/02 220/574 |
| 8,690,002 B1 | * | 4/2014 | Finell | A47G 19/10 220/574.1 |
| 2006/0207993 A1 | * | 9/2006 | Copeland | A47G 19/02 220/574 |
| 2014/0069934 A1 | * | 3/2014 | Wye | A47G 19/02 220/575 |

* cited by examiner

*Primary Examiner* — James N Smalley
*Assistant Examiner* — Madison L Poos
(74) *Attorney, Agent, or Firm* — Ballard Spahr LLP

(57) ABSTRACT

This invention relates to an apparatus that facilitates self-feeding by, for example, a person having limited fine motor skills and methods related thereto. Specifically, the disclosed apparatus enables food to collect in a specific area and guides a utensil to this area. This abstract is intended as a scanning tool for purposes of searching in the particular art and is not intended to be limiting of the present invention.

20 Claims, 28 Drawing Sheets

INTERIOR-FOCUSED SLOPED-SIDED APPARATUS AND METHOD

CROSS-REFERENCE TO RELATED APPLICATIONS

This application claims the benefit of U.S. Provisional Application No. 62/027,990, filed on Jul. 23, 2014, which is incorporated herein fully by reference in its entirety.

BACKGROUND

Individuals having limited fine motor skills, including people suffering from a disability or disorder, accident victims, the elderly, and small children or infants, often lack the manual dexterity to systematically locate and scoop up food out of a dish. Additionally, these individuals may inadvertently put pressure on the top edge of a dish or knock its side, causing it to flip over and spill its contents. Indeed, the challenging task of feeding these individuals often necessitates a caregiver, which can be quite costly.

A variety of feeding dishes have been proposed to facilitate self-feeding by those with restricted motor skills. For example, U.S. Pat. No. 2,683,974 describes feeding dishes having a turned-over rim or lip to assist a person in loading a utensil with food. U.S. Patent Publication No. 2007/0039966 A1 describes transparent feeding dishes having a spoon-shaped locus and an inward curving rim to assist a person in scooping up food onto a spoon. However, in each of these instances the person must still be able to locate the food with the utensil and scoop the food up. Additionally, the person must also be able to maintain the utensil in a proper plane so as to balance the food on the utensil. Accordingly, there remains a need for feeding dishes that facilitate self-feeding by individuals with limited fine motor skills. These needs and others are met by the present invention.

SUMMARY

In accordance with the purpose(s) of the invention, as embodied and broadly described herein, the invention, in one aspect, relates to adjustable garments and methods of making same.

Disclosed are apparatuses comprising: (a) a base having a largest dimension of from about 3.0 inches to about 12 inches; (b) a top edge having a largest dimension of from about 3.0 inches to about 10 inches; (c) a food collection area having a largest dimension of less than about 2.5 inches; (d) an interior wall that extends from the top edge to the food collection area at an angle of from about 10° to about 60°; and (e) an exterior wall that extends from the top edge to the base, wherein the apparatus has an external height of from about 1.0 inch to about 12.0 inches, wherein the external height is the vertical distance between the top edge and the base, and wherein the apparatus has an internal height of from about 1.0 inch to about 3.5 inches, wherein the internal height is the vertical distance between the top edge and the food collection area.

Also disclosed are apparatuses comprising: (a) a base having a largest dimension of from about 4.0 inches to about 6.0 inches; (b) a top edge having a largest dimension of from about 4.0 inches to about 6.0 inches; (c) a food collection area having a largest dimension of less than about 2.0 inches; (d) an interior wall that extends from the top edge to the food collection area at an angle of from about 20° to about 45°; and (e) an exterior wall that extends from the top edge to the base, wherein the apparatus has an external height of from about 1.5 inches to about 3.5 inches, wherein the external height is the vertical distance between the top edge and the base, and wherein the apparatus has an internal height of from about 1.0 inch to about 3.5 inches, wherein the internal height is the vertical distance between the top edge and the food collection area.

Also disclosed are methods comprising: (a) providing an apparatus comprising: (i) a base having a largest dimension of from about 3.0 inches to about 12 inches; (ii) a top edge having a largest dimension of from about 3.0 inches to about 10 inches; (iii) a food collection area having a largest dimension of less than about 2.5 inches, wherein the food collection area contains food; (iv) an interior wall that extends from the top edge to the food collection area at an angle of from about 10° to about 60°; and (v) an exterior wall that extends from the top edge to the base, wherein the apparatus has an external height of from about 1.0 inch to about 12.0 inches, wherein the external height is the vertical distance between the top edge and the base, and wherein the apparatus has an internal height of from about 1.0 inch to about 3.5 inches, wherein the internal height is the vertical distance between the top edge and the food collection area; (b) providing a utensil comprising a handle end and a food end; (c) inserting the utensil into the food collection area, thereby getting food onto the food end; and (d) inserting the food end into a person's mouth, thereby transferring food from the food collection area into the person's mouth.

Also disclosed are kits comprising an apparatus comprising: (a) a base having a largest dimension of from about 3.0 inches to about 12 inches; (b) a top edge having a largest dimension of from about 3.0 inches to about 10 inches; (c) a food collection area having a largest dimension of less than about 2.5 inches; (d) an interior wall that extends from the top edge to the food collection area at an angle of from about 10° to about 60°; and (e) an exterior wall that extends from the top edge to the base, wherein the apparatus has an external height of from about 1.0 inch to about 12.0 inches, wherein the external height is the vertical distance between the top edge and the base, and wherein the apparatus has an internal height of from about 1.0 inch to about 3.5 inches, wherein the internal height is the vertical distance between the top edge and the food collection area, and one or more of: (a) a utensil comprising a handle end and a food end; and (b) a lid.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

BRIEF DESCRIPTION OF THE FIGURES

The accompanying figures, which are incorporated in and constitute a part of this specification, illustrate several aspects and together with the description serve to explain the principles of the invention.

Figure 1A:
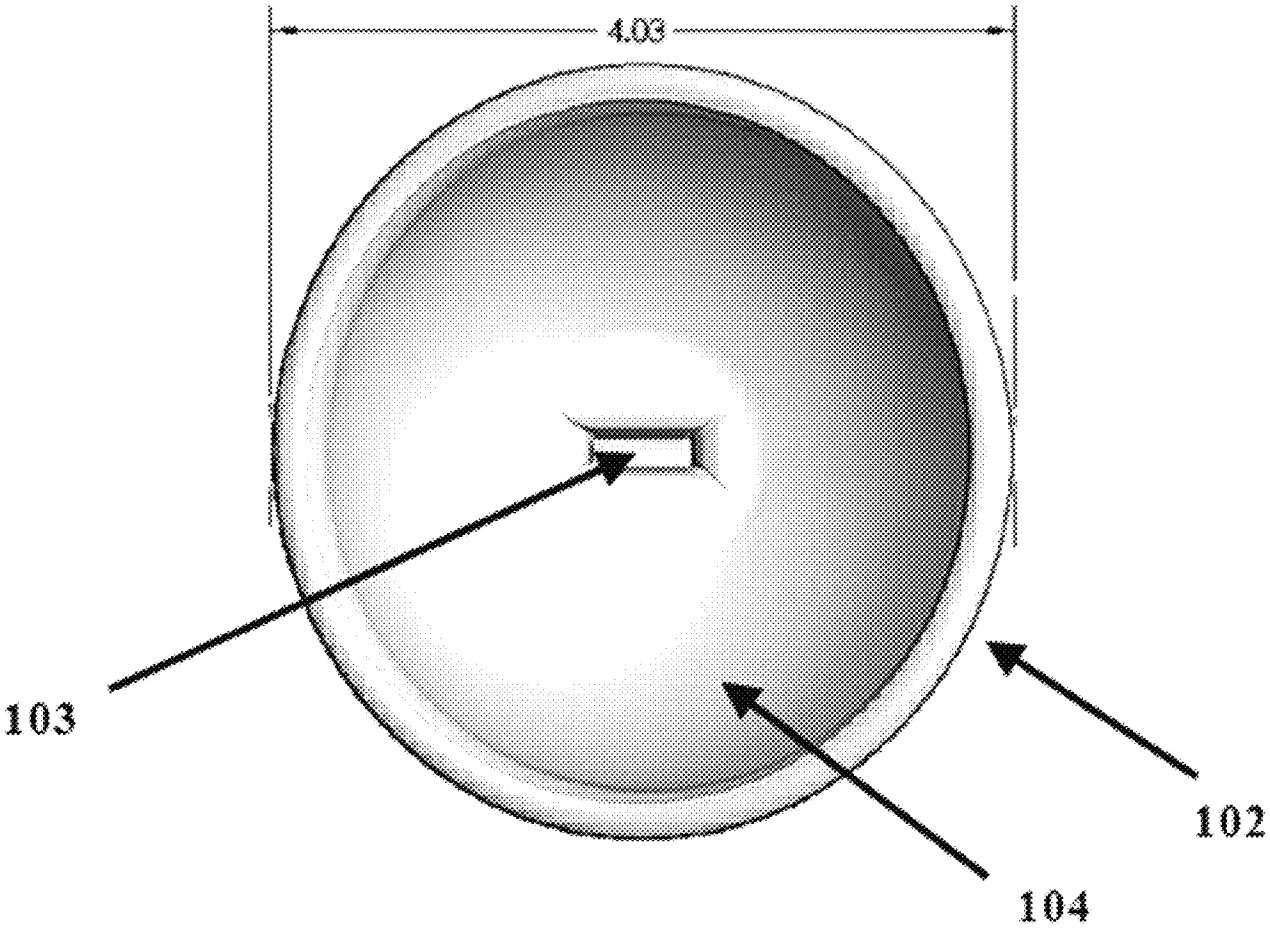
FIG. 1A-C show a representative image of a bowl having a range of external heights and a food collection area comprising a planar surface. A top view (FIG. 1A) and cross-sectional view (FIG. 1B) taken in the plane of AA as shown in the side view (FIG. 1C) are illustrated.

Additional advantages of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION

The present invention can be understood more readily by reference to the following detailed description of the invention and the Examples and Figures included herein.

While aspects of the present invention can be described and claimed in a particular statutory class, such as the article of manufacture statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein may be different from the actual publication dates, which can require independent confirmation.

A. Definitions

As used in the specification and the appended claims, the singular forms "a," "an" and "the" include plural referents unless the context clearly dictates otherwise. Thus, for example, reference to "a top edge," "an interior surface," or "a utensil" includes aspects wherein there are two or more such top edges, interior surfaces, or utensils, and the like.

Ranges can be expressed herein as from "about" one particular value, and/or to "about" another particular value. When such a range is expressed, a further aspect includes from the one particular value and/or to the other particular value. Similarly, when values are expressed as approximations, by use of the antecedent "about," it will be understood that the particular value forms a further aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "optional" or "optionally" means that the subsequently described event or circumstance can or cannot occur, and that the description includes instances where said event or circumstance occurs and instances where it does not.

B. Apparatus

In one aspect, disclosed is an apparatus comprising: (a) a base having a largest dimension of from about 3.0 inches to about 12 inches; (b) a top edge having a largest dimension of from about 3.0 inches to about 10 inches; (c) a food collection area having a largest dimension of less than about 2.5 inches; (d) an interior wall that extends from the top edge to the food collection area at an angle of from about 10° to about 60°; and (e) an exterior wall that extends from the top edge to the base, wherein the apparatus has an external height of from about 1.0 inch to about 12.0 inches, wherein the external height is the vertical distance between the top edge and the base, and wherein the apparatus has an internal height of from about 1.0 inch to about 3.5 inches, wherein the internal height is the vertical distance between the top edge and the food collection area.

In one aspect, apparatuses comprising: (a) a base having a largest dimension of from about 4.0 inches to about 6.0 inches; (b) a top edge having a largest dimension of from about 4.0 inches to about 6.0 inches; (c) a food collection area having a largest dimension of less than about 2.0 inches; (d) an interior wall that extends from the top edge to the food collection area at an angle of from about 20° to about 45°; and (e) an exterior wall that extends from the top edge to the base, wherein the apparatus has an external height of from about 1.5 inches to about 3.5 inches, wherein the external height is the vertical distance between the top edge and the base, and wherein the apparatus has an internal height of from about 1.0 inch to about 3.5 inches, wherein the internal height is the vertical distance between the top edge and the food collection area are disclosed.

Figure 1B:
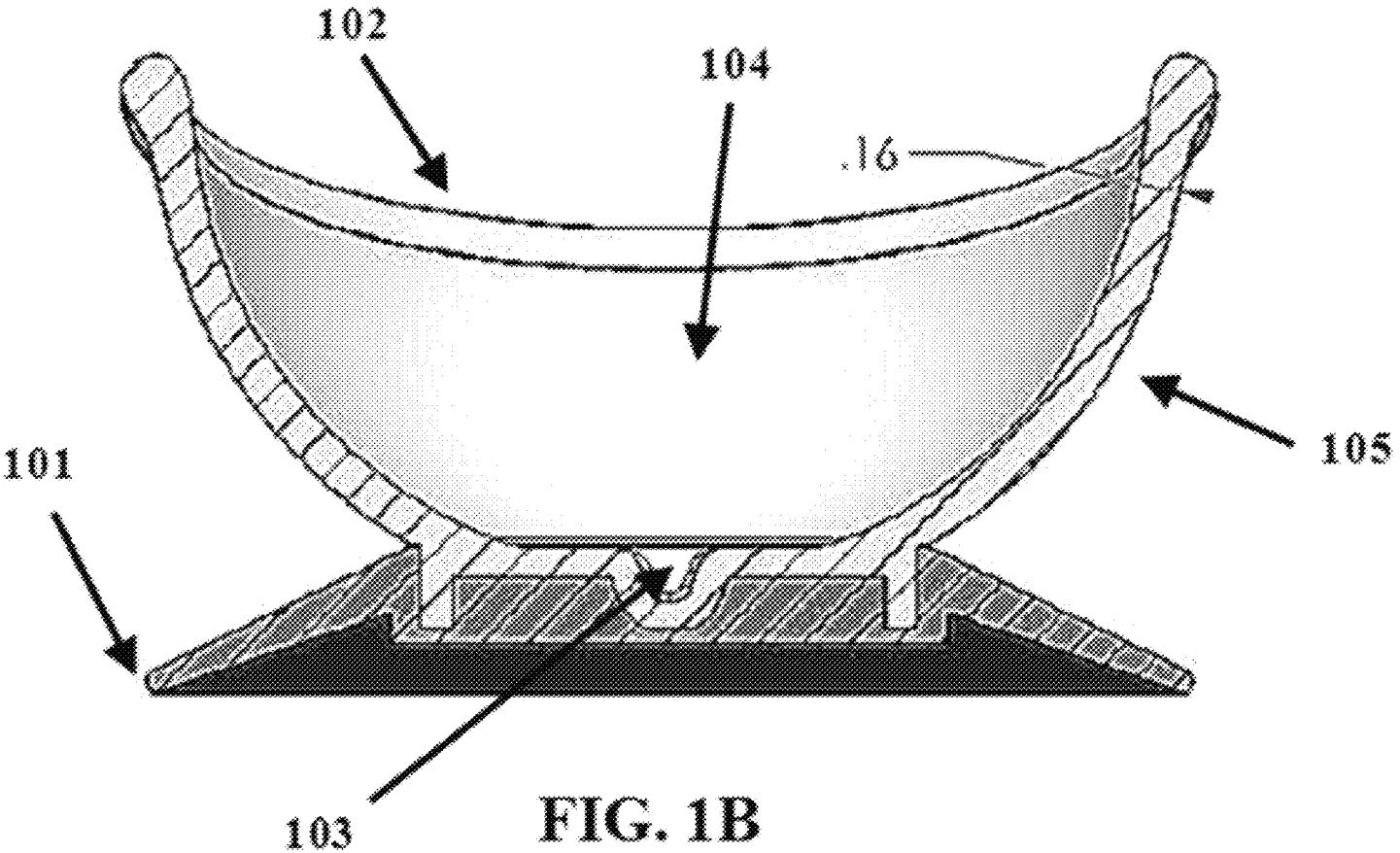
Figure 1C:
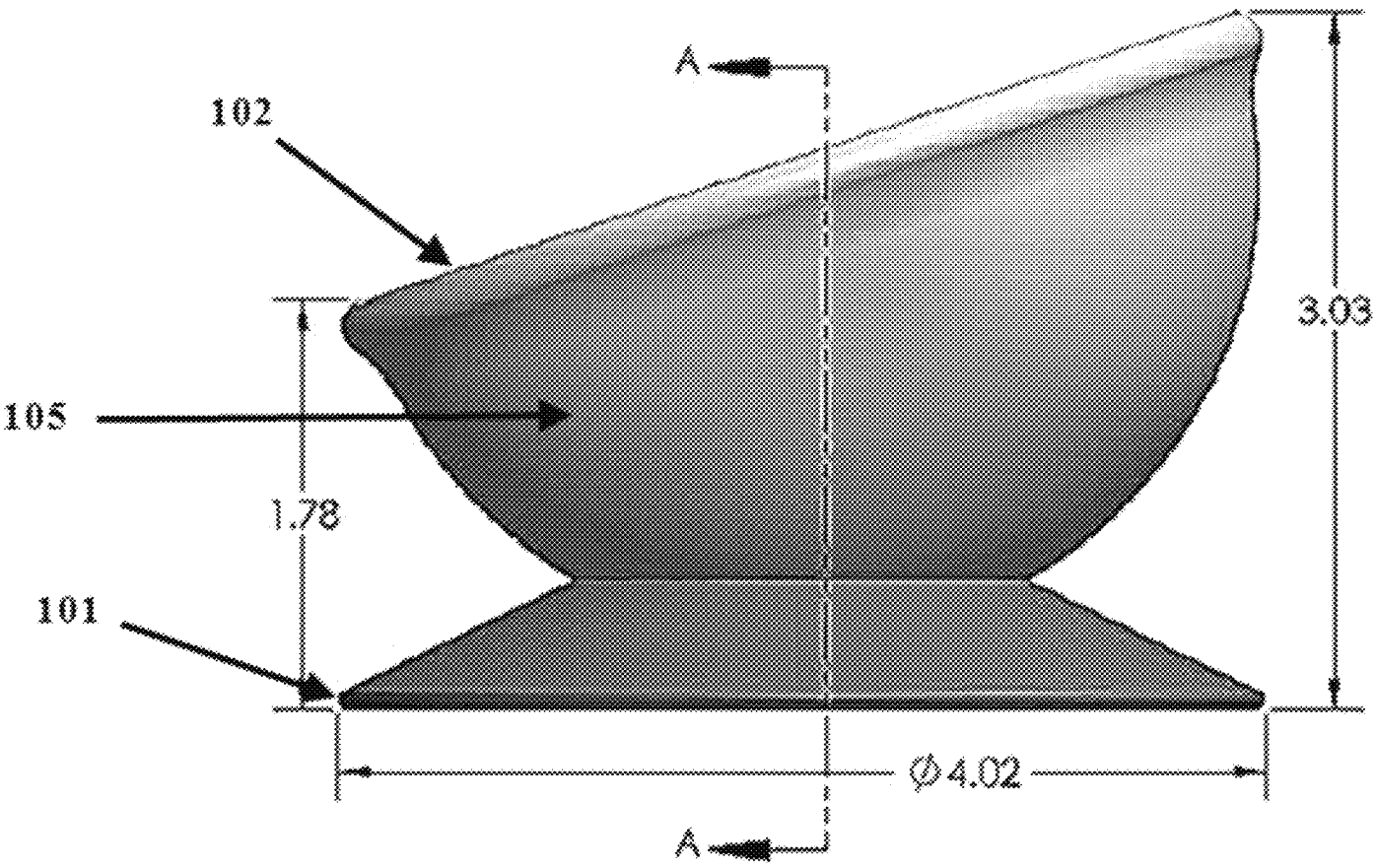

Referring to FIG. 1A-C, for example, the base 101 and the top edge 102 are not parallel. The largest dimension of the base 101 and the top edge 102 may be approximately the same. The top edge 102 may define a circle, as shown in FIG. 1A, but other shapes, such as, for example, oval, square, rectangle, triangle, and heat-shaped, are also envisioned. The interior wall 104 extends from the top edge 102 to the food collection area 103. As shown here, the food collection area 103 need not extend seamlessly from the interior wall 104. The food collection area 103 may comprise a rectangular concave surface, as shown in FIG. 1A, but other shaped surfaces, such as, for example, circular, oval, square, triangular, and heat-shaped, are also envisioned. The exterior wall 105 extends from the top edge 102 to the base 101. The exterior wall 105 need not extend straight down from the top edge 102 to the base 101, as shown in FIG. 1B and FIG. 1C, or alternatively, may extend straight down from the top edge to the base. The exterior wall 105 has a range of external heights (e.g., about 1.78 inches to about 3.03 inches, as shown here). All units are in inches.

Figure 2A:
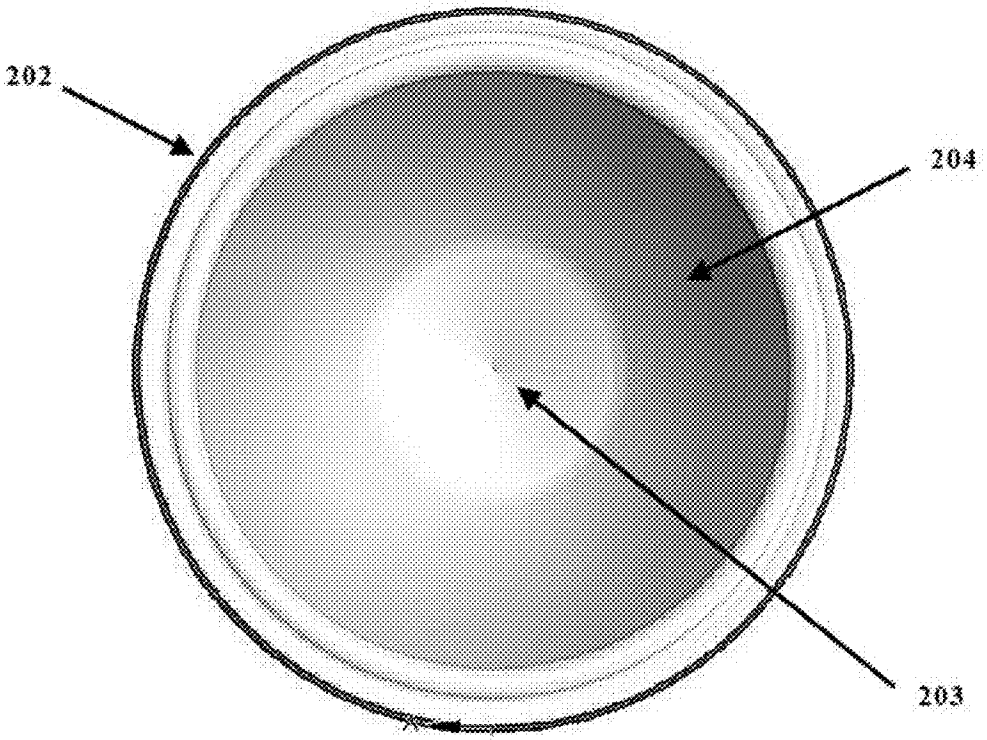
FIG. 2A-C show a representative image of a bowl having a uniform external height and a food collection area that is a point. A top view (FIG. 2A) and cross-sectional view (FIG. 2B) taken in the plane of AA as shown in the side view (FIG. 2C) are illustrated.
Figure 2B:
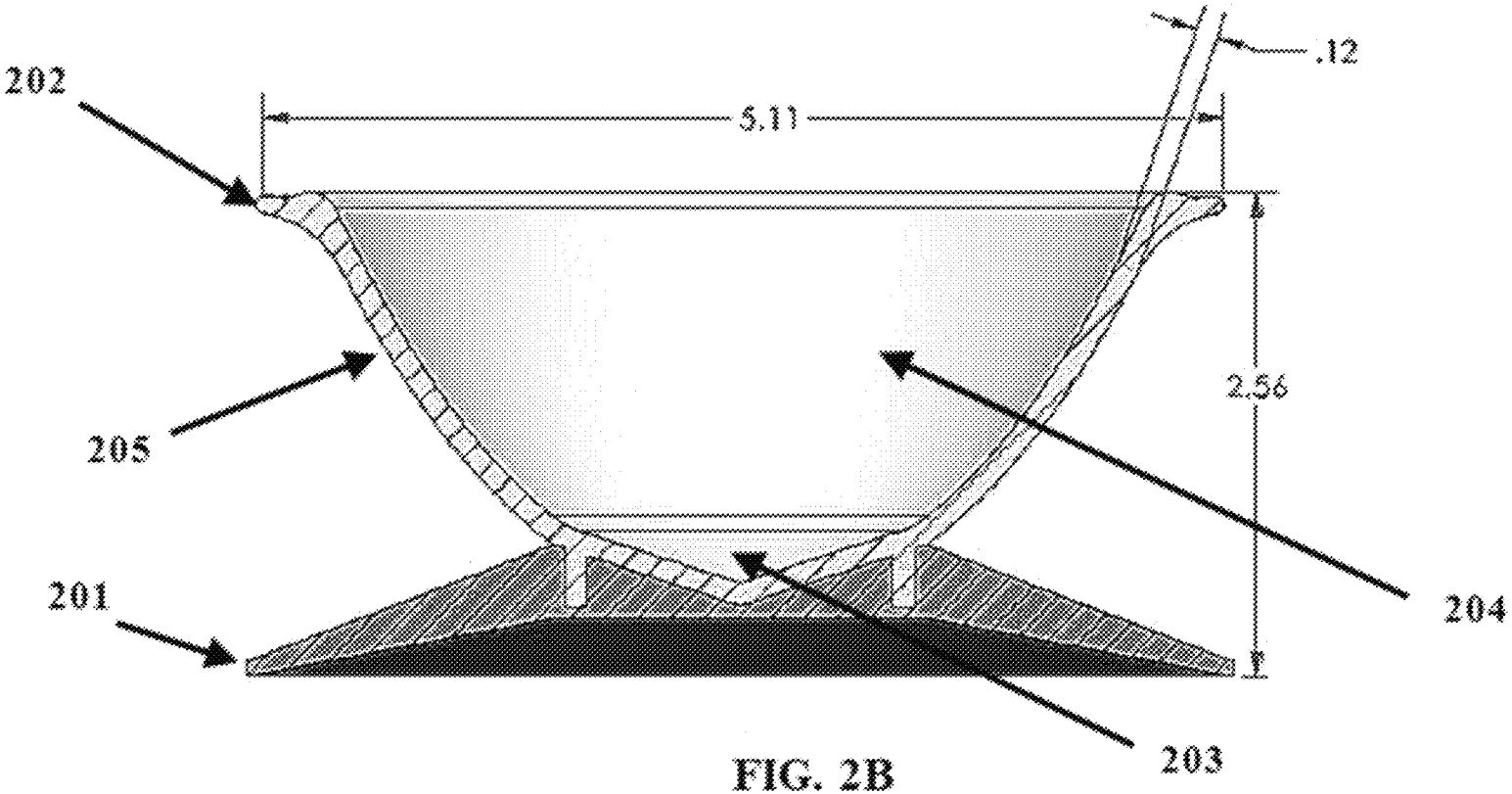
Figure 2C:
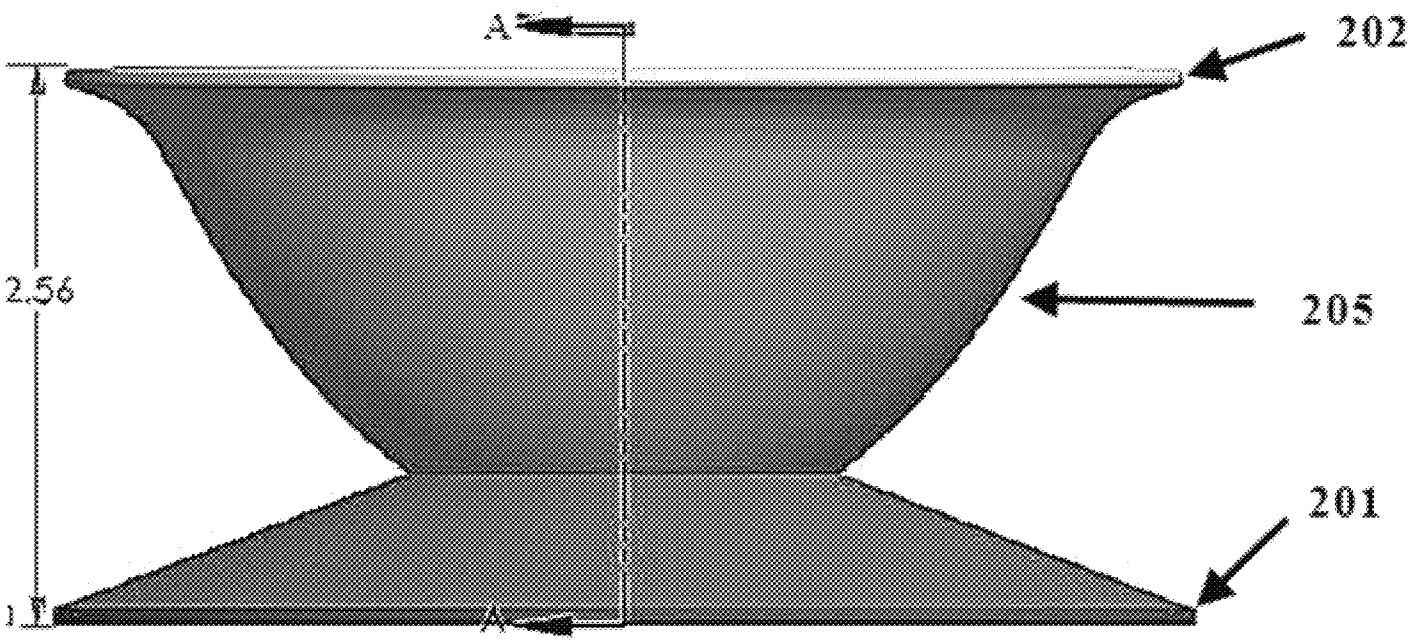

Referring to FIG. 2A-C, for example, the base 201 and the top edge 202 are parallel. The largest dimension of the base 201 and the top edge 202 may be approximately the same. The interior wall 204 extends from the top edge 202 to the food collection area 203. The food collection area 203 may comprise a point. As shown here, the food collection area 203 terminates in a point. The exterior wall 205 extends from the top edge 202 to the base 201. The exterior wall 205 has a uniform external height (e.g., 2.56 inches, as shown here). All units are in inches.

Figure 3A:
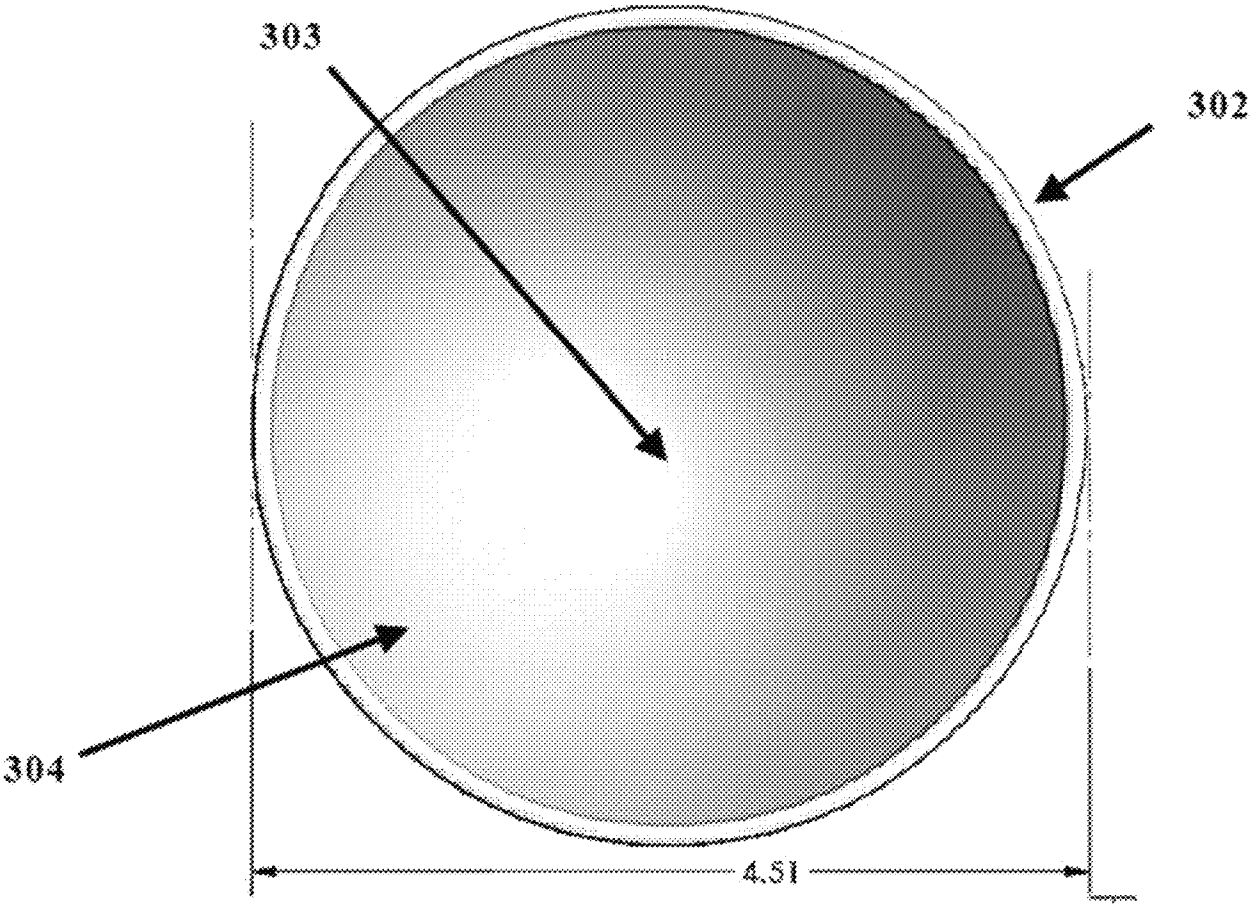
FIG. 3A-C show a representative image of a bowl having a range of external heights and a food collection area comprising a concave surface. A top view (FIG. 3A) and cross-sectional view (FIG. 3B) taken in the plane of AA as shown in the side view (FIG. 3C) are illustrated.
Figure 3B:
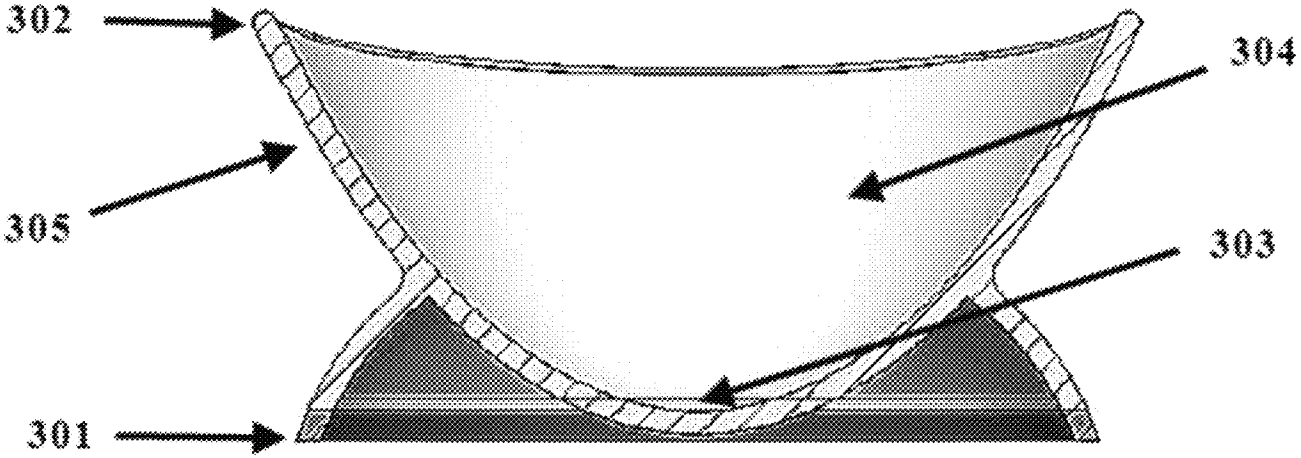
Figure 3C:
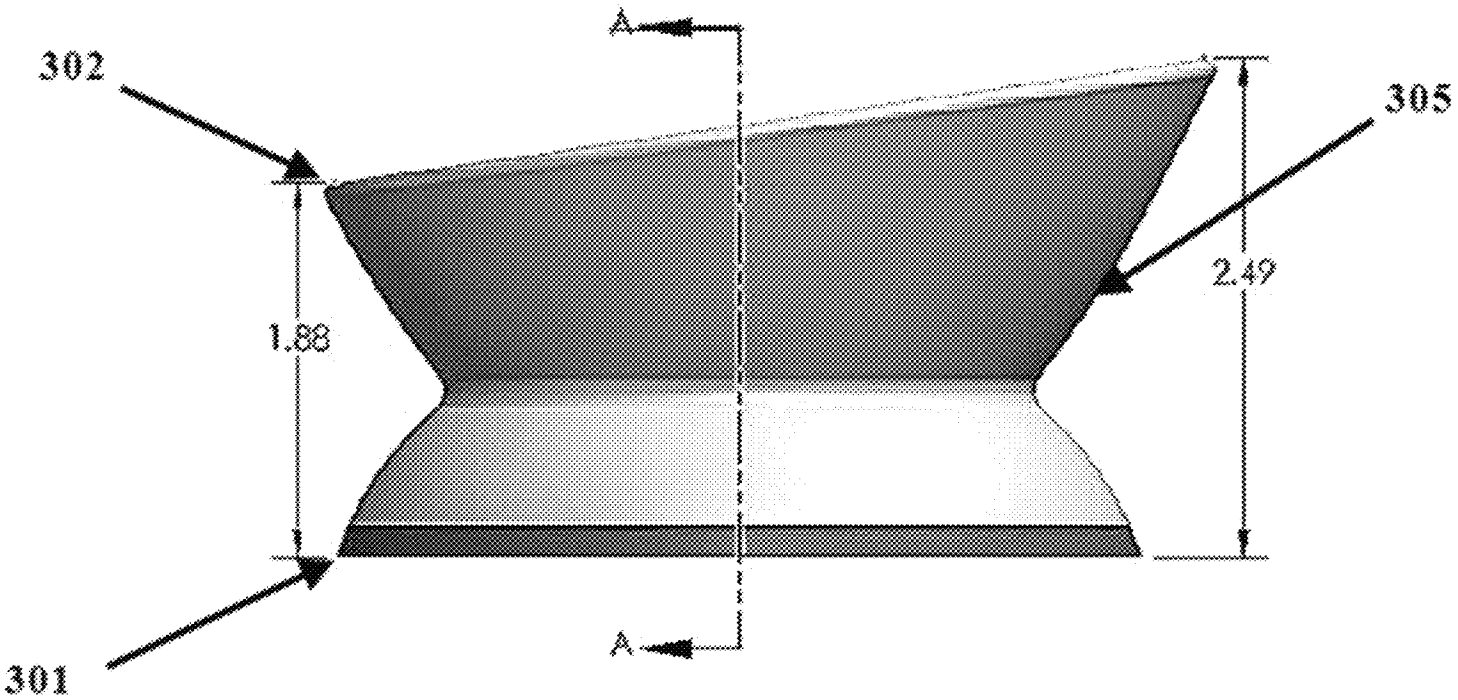

Referring to FIG. 3A-C, for example, the base 301 and the top edge 302 are not parallel. The largest dimension of the base 301 and the top edge 302 may be approximately the same. The interior wall 304 extends from the top edge 302 to the food collection area 303. The food collection area 303 may comprise a concave surface. As shown here, the food collection area 303 may extend seamlessly from the interior wall 304. The exterior wall 305 extends from the top edge 302 to the base 301. The exterior wall 305 has a range of external heights (e.g., about 1.88 inches to about 2.49 inches, as shown here). All units are in inches.

Figure 4A:
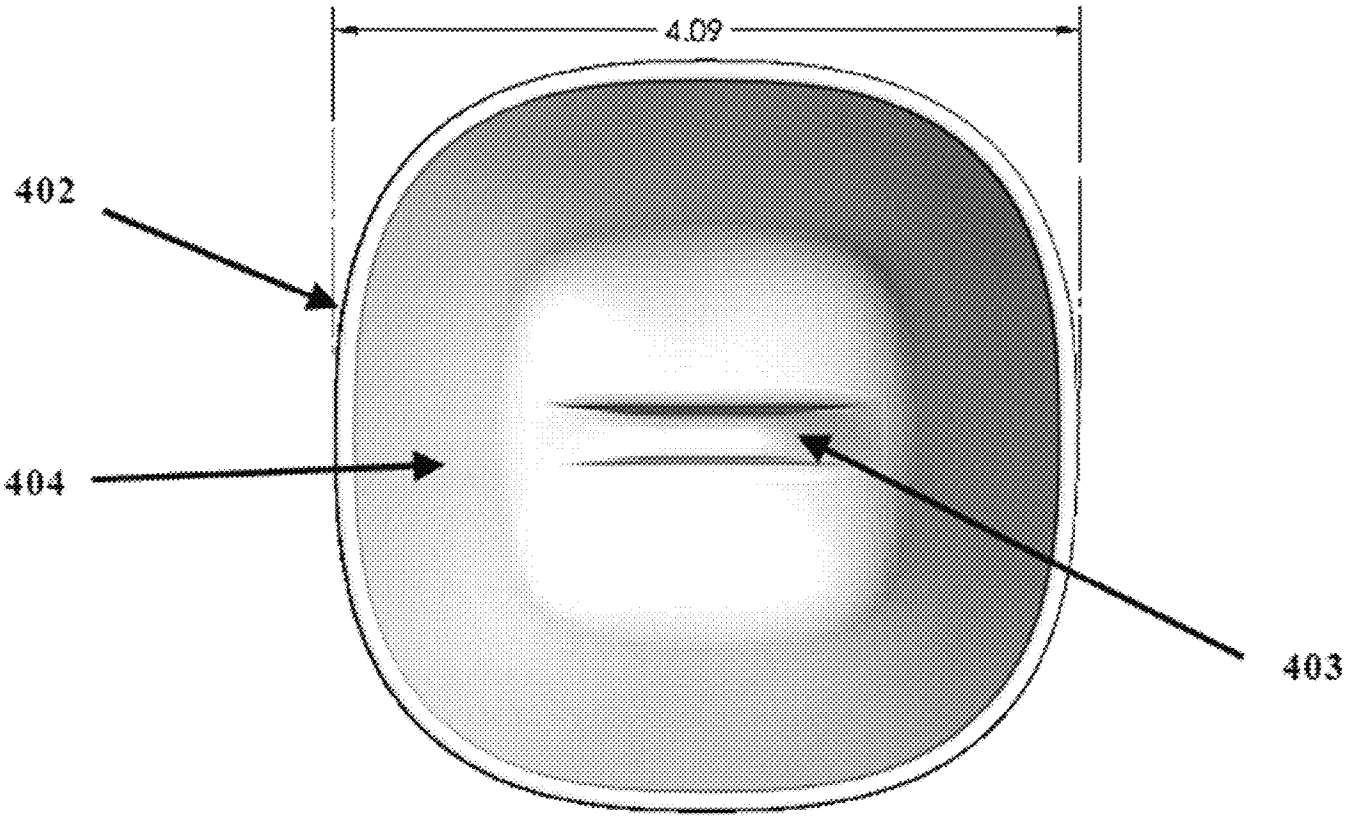
FIG. 4A-C show a representative image of a bowl having a uniform external height and a food collection area comprising a concave surface. A top view (FIG. 4A) and cross-sectional view (FIG. 4B) taken in the plane of AA as shown in the side view (FIG. 4C) are illustrated.
Figure 4B:
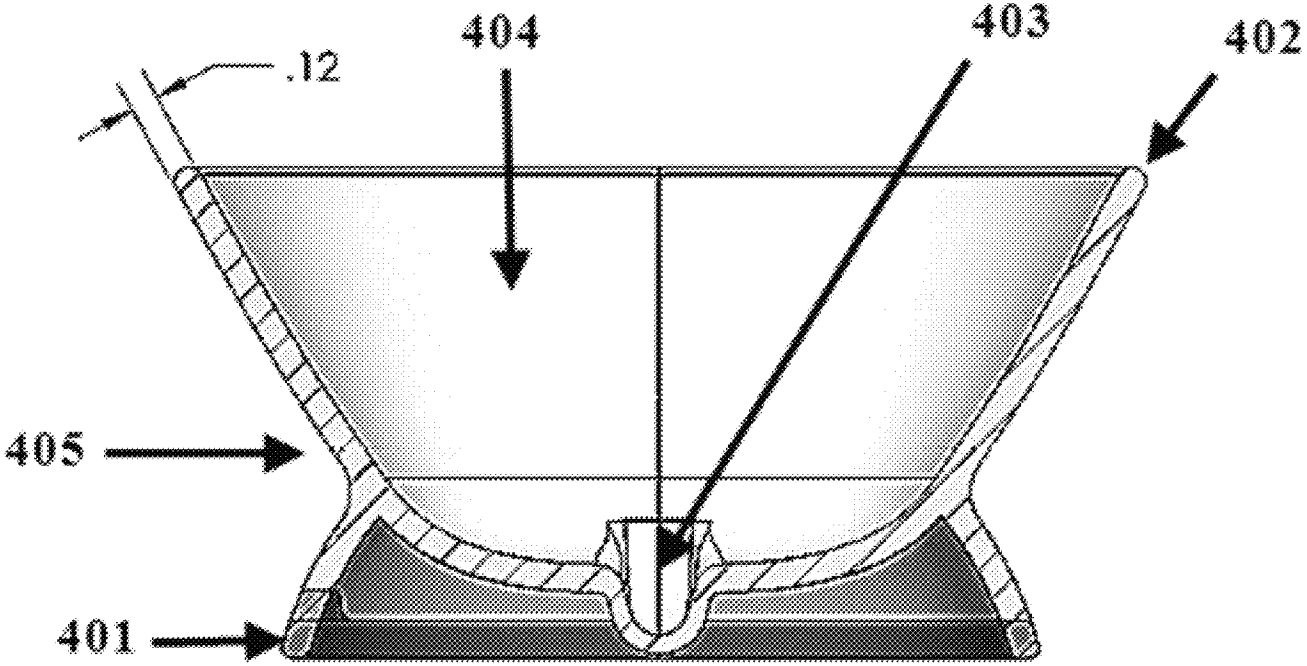
Figure 4C:
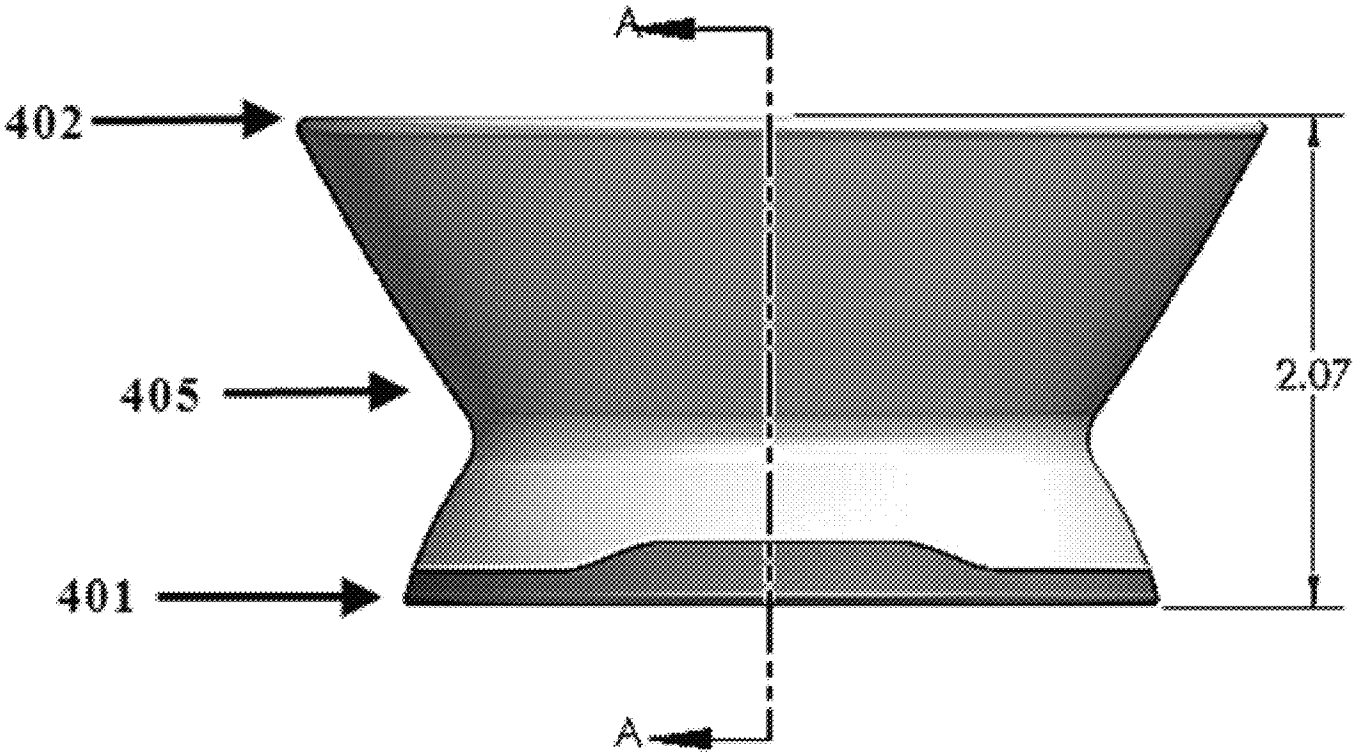

Referring to FIG. 4A-C, for example, the base 401 and the top edge 402 are parallel. The top edge 402 may define a square, as shown in FIG. 4A, but other shapes, such as, for example, circle, oval, rectangle, triangle, and heat-shaped, are also envisioned. The interior wall 404 extends from the top edge 402 to the food collection area 403. As shown here, the food collection area 403 need not extend seamlessly from the interior wall 404. The exterior wall 405 extends from the top edge 402 to the base 401. The exterior wall 405 has a uniform external height (e.g., 2.07 inches, as shown here). All units are in inches.

Figure 5A:
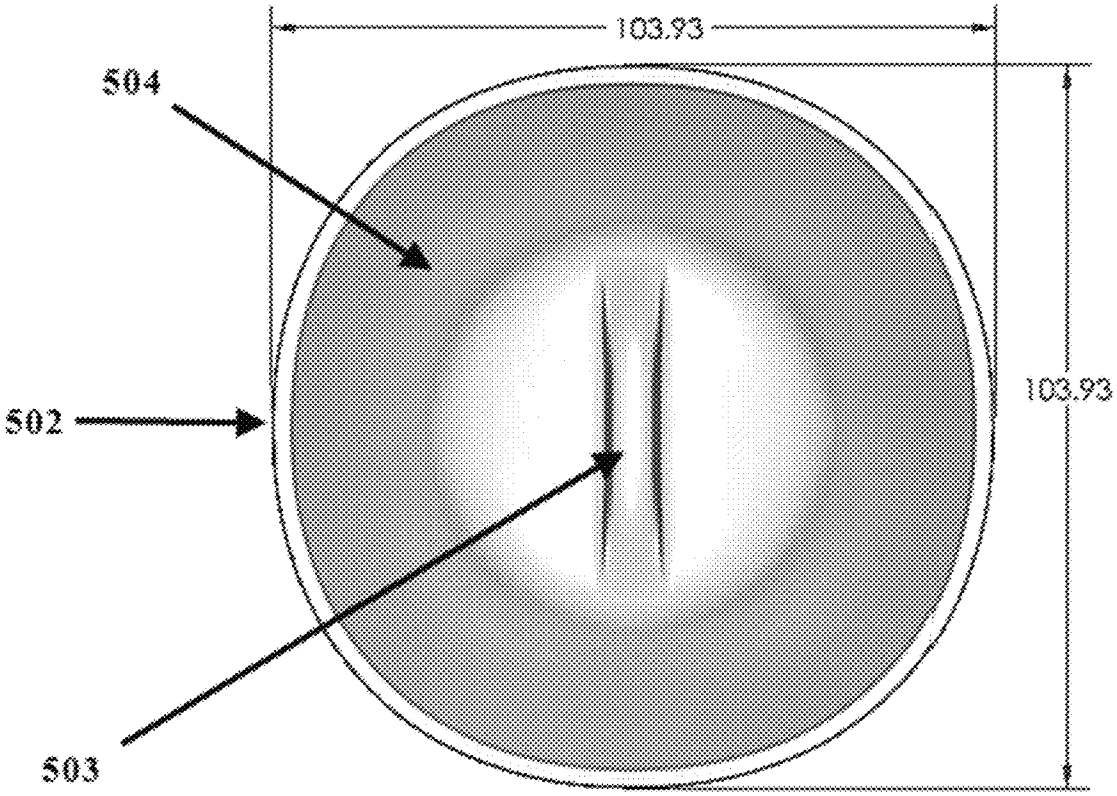
FIG. 5A-C show a representative image of a bowl having a uniform external height and a food collection area comprising a planar surface. A top view (FIG. 5A) and cross-sectional view (FIG. 5B) taken in the plane of CC as shown in the side view (FIG. 5C) are illustrated.
Figure 5B:
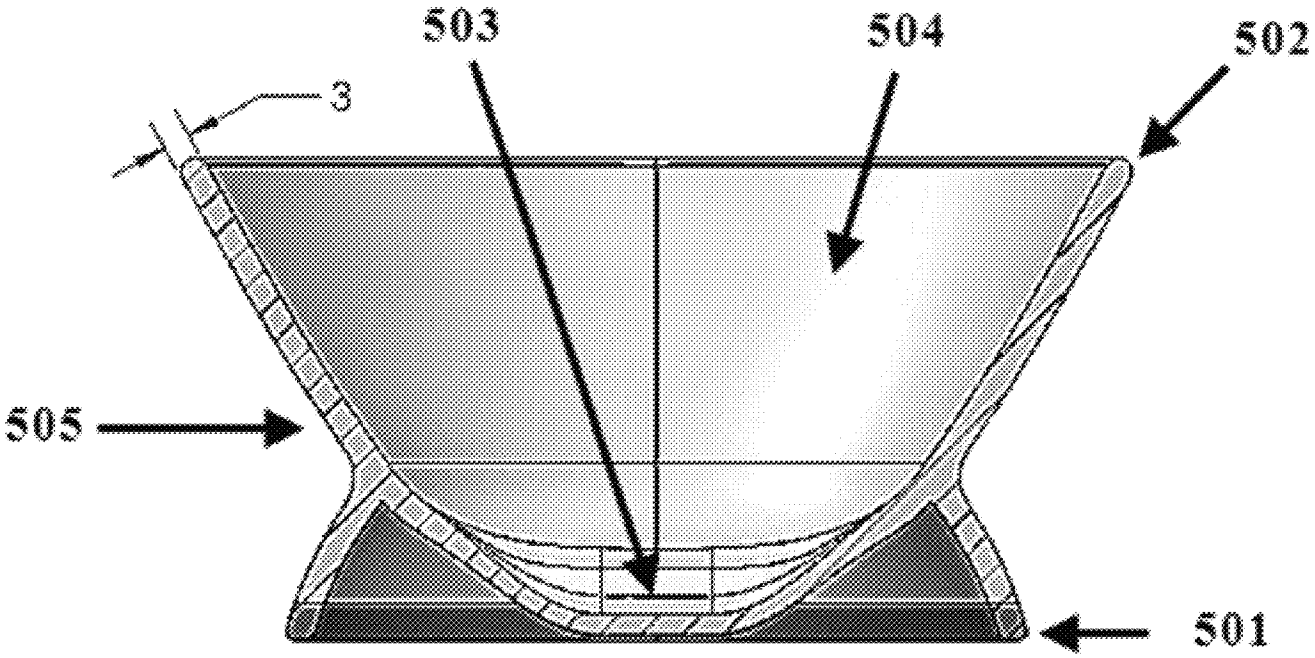
Figure 5C:
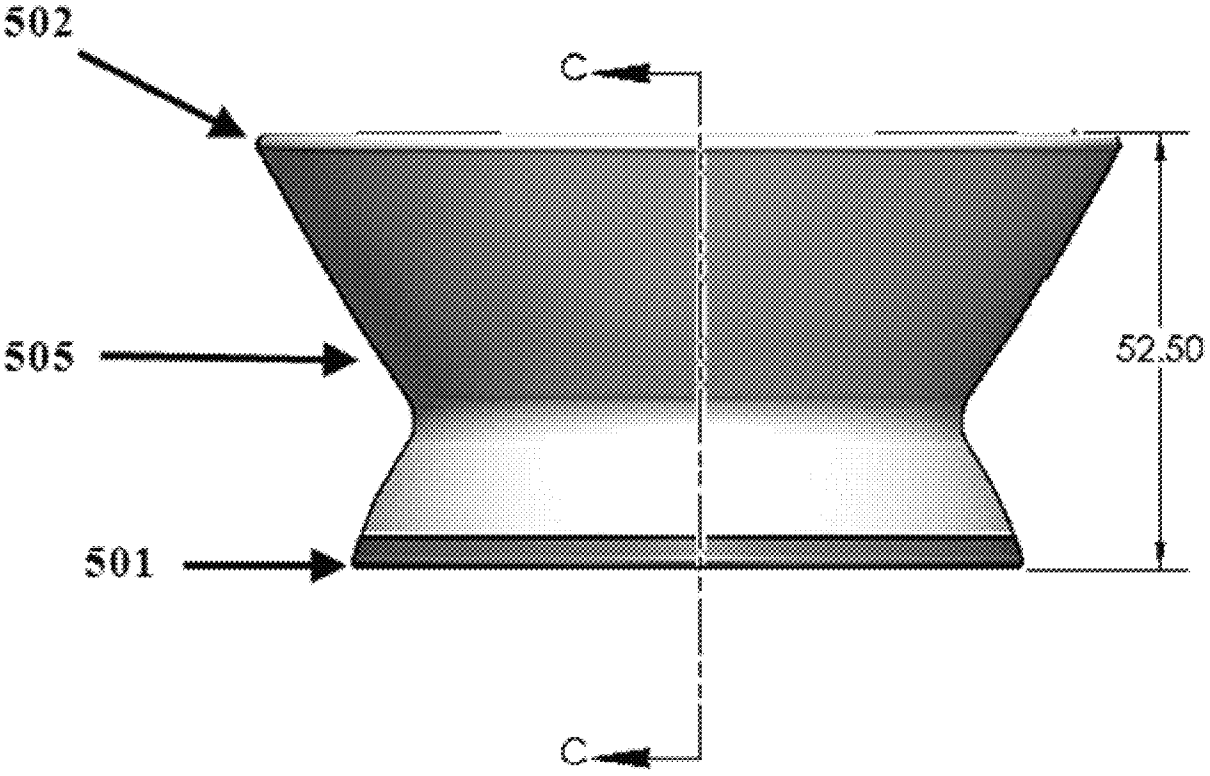

Referring to FIG. 5A-C, for example, the base 501 and the top edge 502 are parallel. The top edge 502 may define a circle, as shown in FIG. 5A, but other shapes, such as, for example, oval, square, rectangle, triangle, and heat-shaped, are also envisioned. The interior wall 504 extends from the top edge 502 to the food collection area 503. The exterior wall 505 extends from the top edge 502 to the base 501. The exterior wall 505 has a uniform external height (e.g., 52.50 mm or 2.07 inches, as shown here). All units are in millimeters.

Figure 6A:
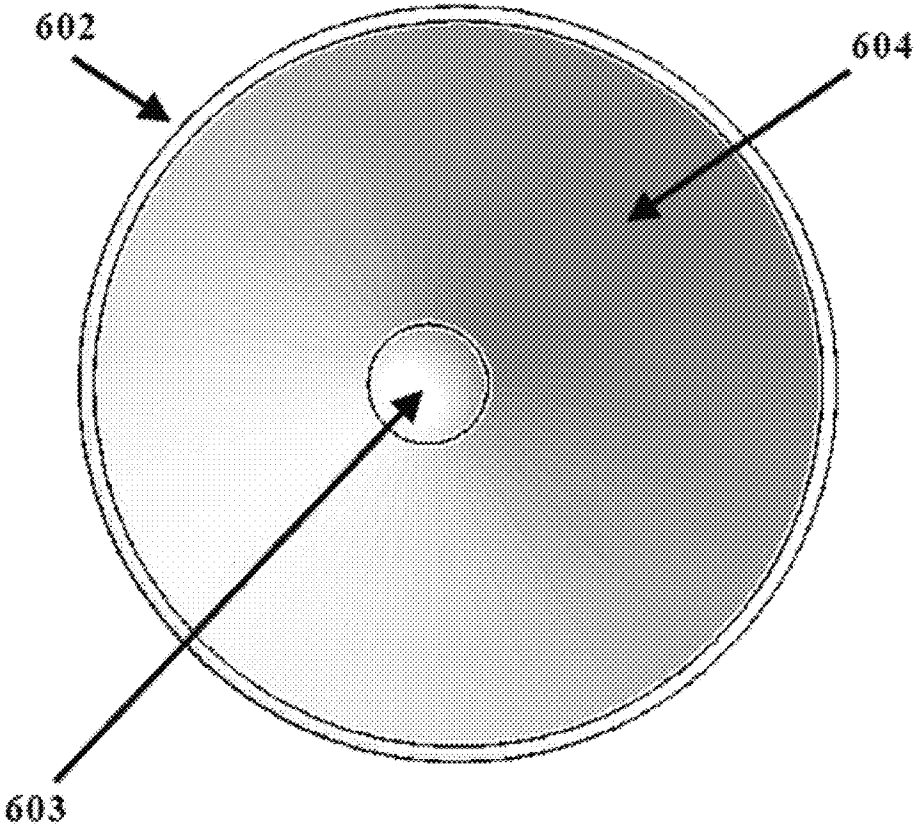
FIG. 6A-D show a representative image of a bowl having a range of external heights and a food collection area comprising a concave surface, in which the food collection area is off center. In this exemplary image, the plane of the top edge is not parallel to the plane of the base. A top view (FIG. 6A), side view (FIG. 6B), and cross-sectional view (FIG. 6C) taken in the plane of AA as shown in a side view (FIG. 6D) are illustrated.
Figure 6B:
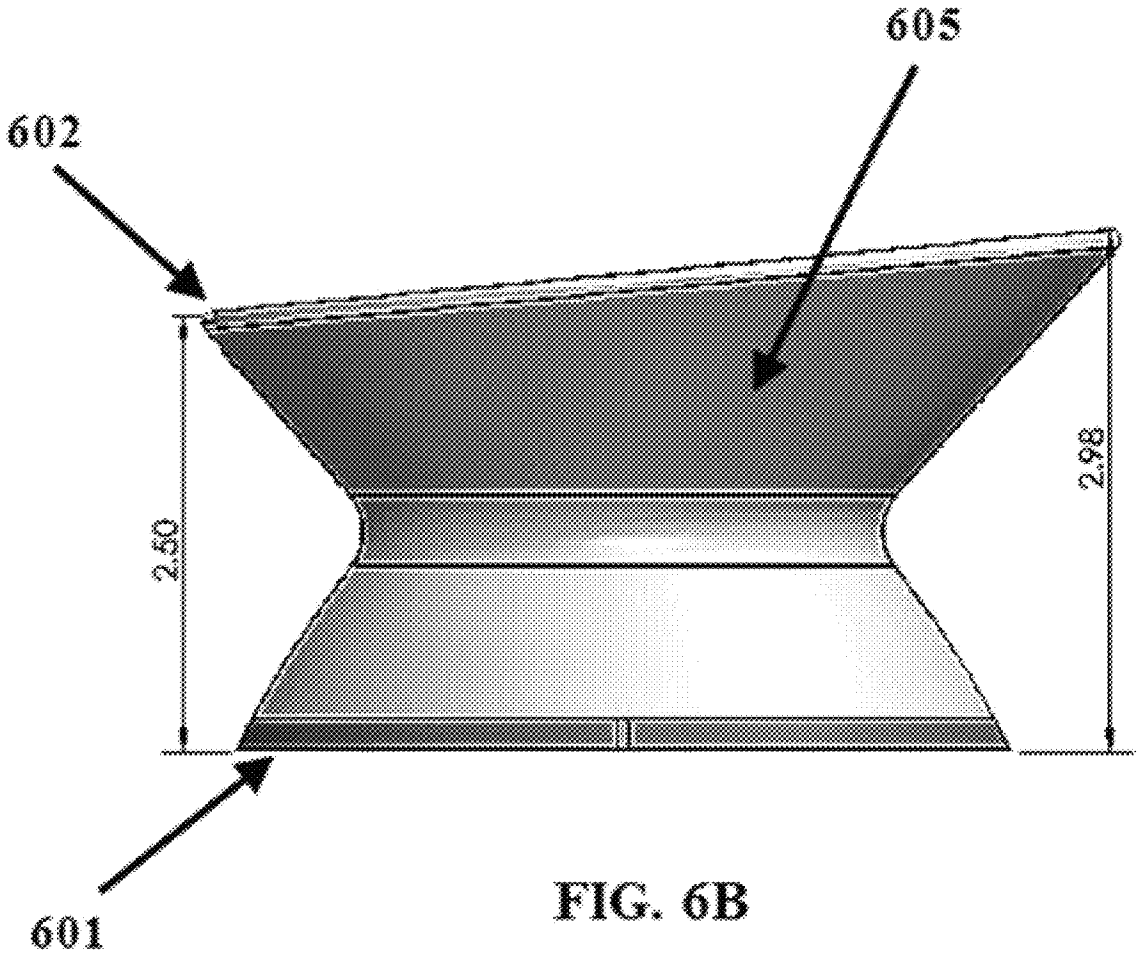
Figure 6C:
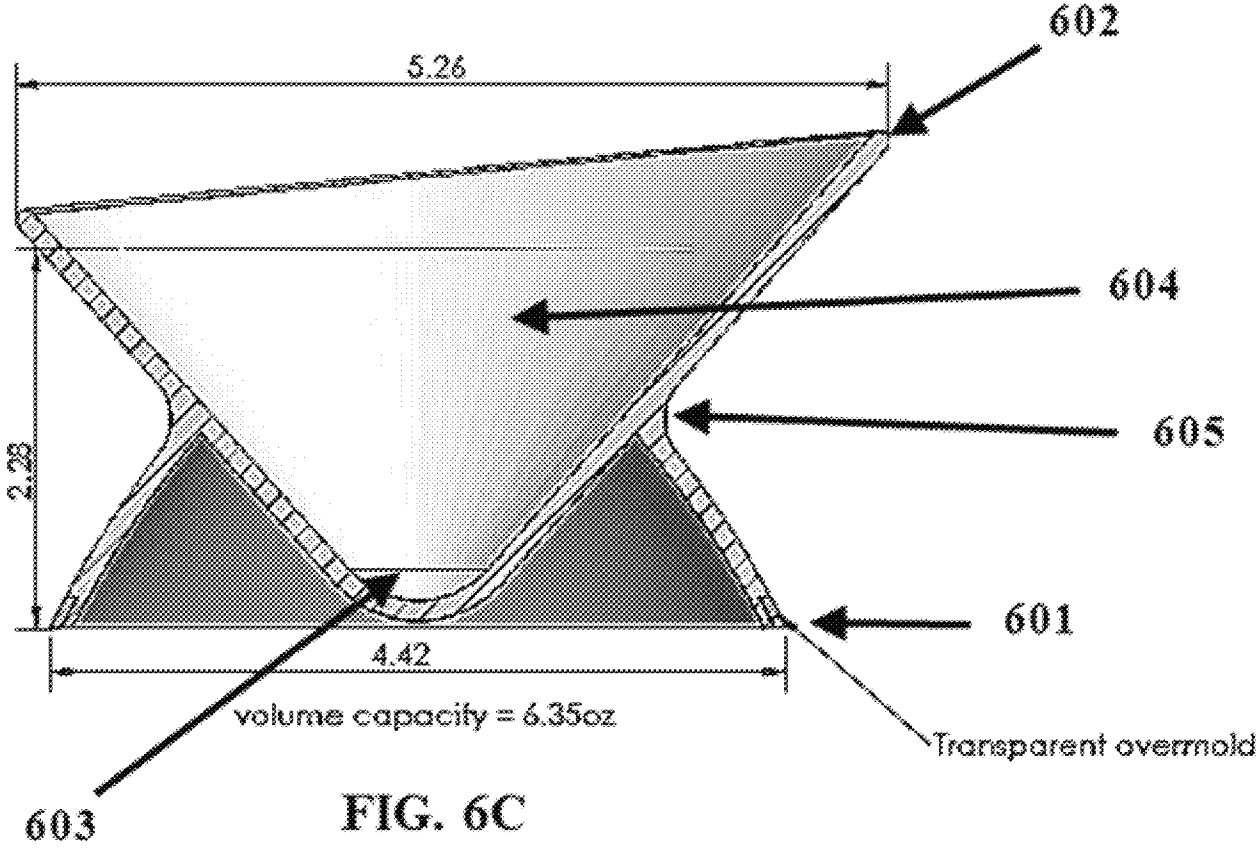
Figure 6D:
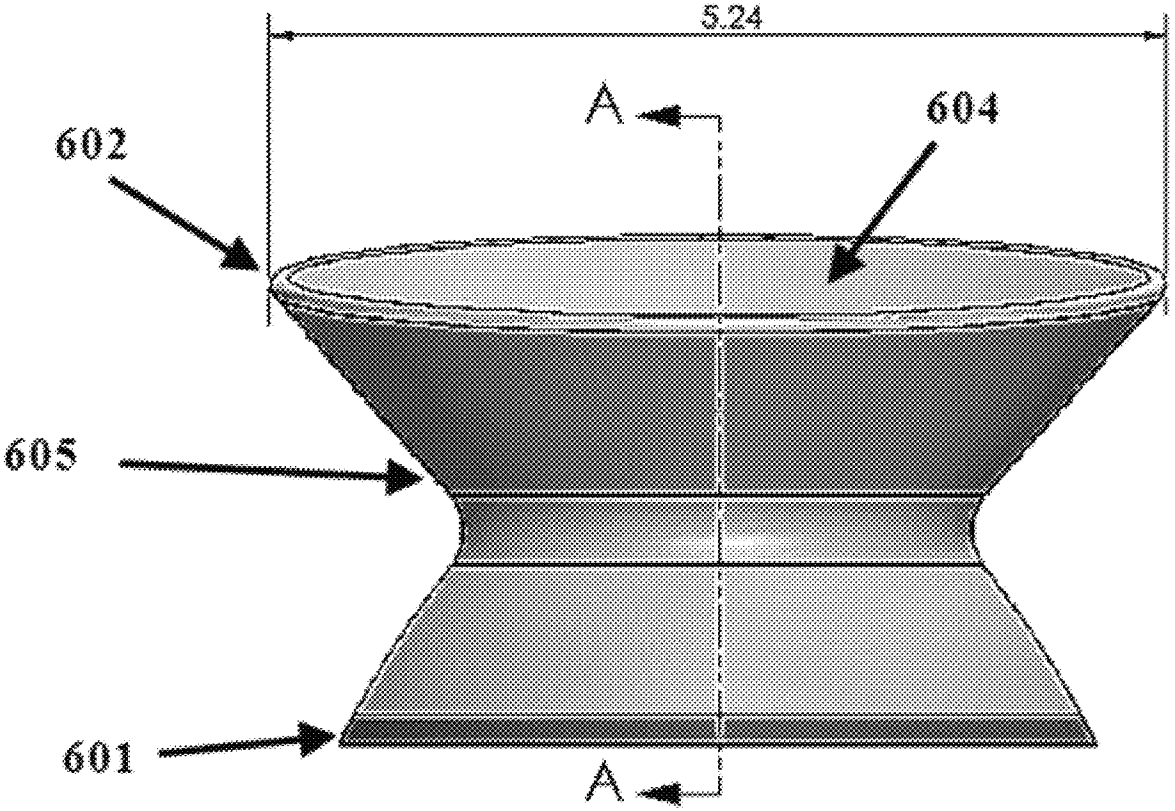

Referring to FIG. 6A-D, for example, the base 601 and the top edge 602 are not parallel. The largest dimension of the base 601 and the top edge 602 may be different. The interior wall 604 extends from the top edge 602 to the food collection area 603. The food collection area 603 need not be in the center of the shape defined by the base 601 or the shape defined by the top edge 602, as shown in FIG. 6A and FIG. 6C. The food collection area 603 may comprise a concave surface, as shown in FIG. 6C. The exterior wall 605 extends from the top edge 602 to the base 601. The exterior wall 605 has a range of external heights (e.g., about 2.50 inches to about 2.98 inches, as shown here). All units are in inches.

Figure 7A:
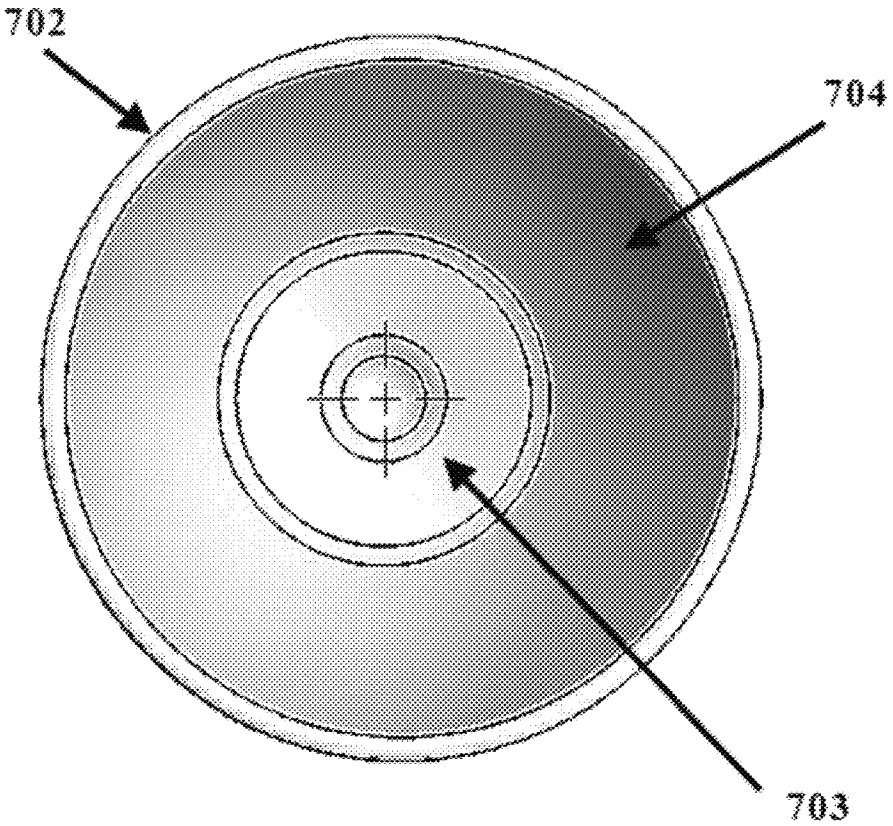
FIG. 7A-D show a representative image of a bowl having a range of external heights and a food collection comprising a concave surface. A top view (FIG. 7A), side view (FIG. 7B), and cross-sectional view (FIG. 7C) taken in the plane of AA as shown in a side view (FIG. 7D) are illustrated.
Figure 7B:
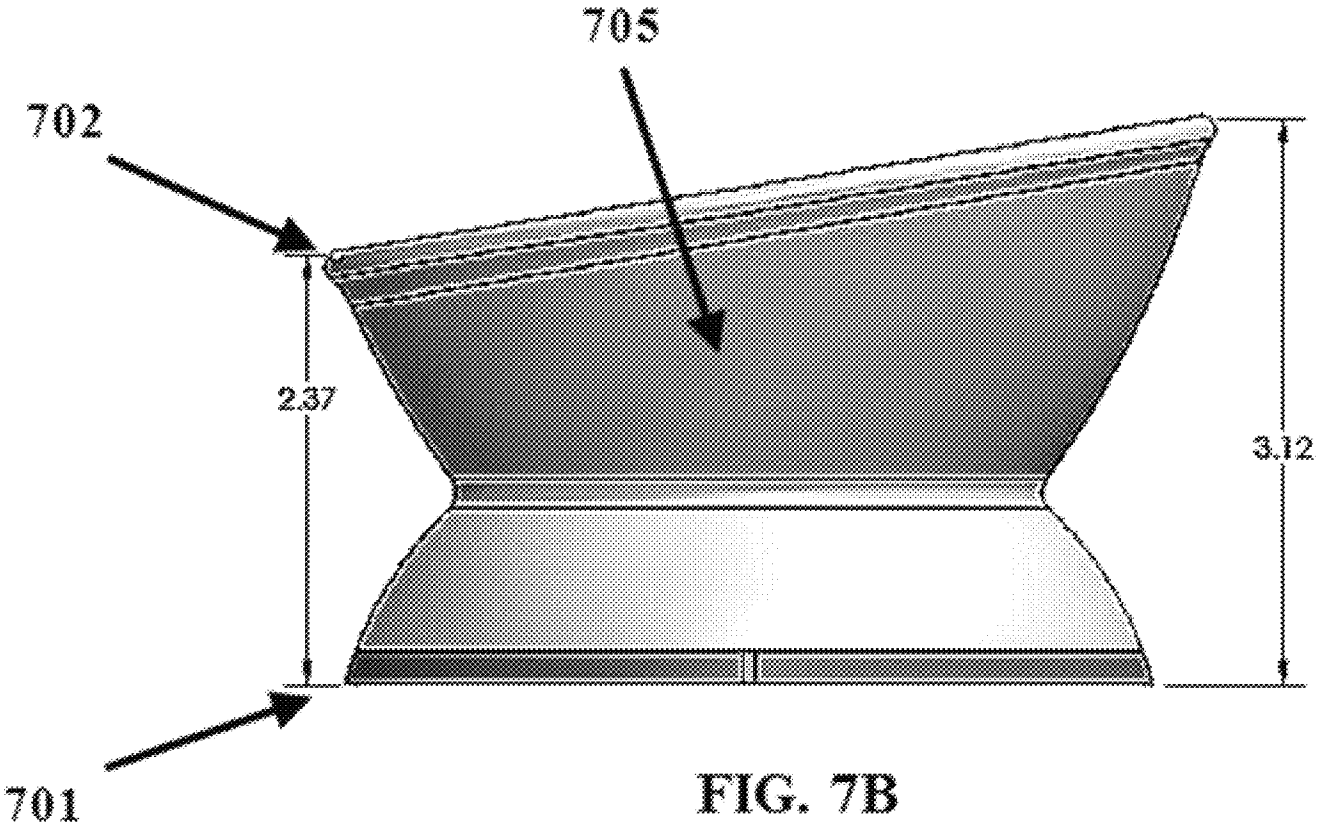
Figure 7C:
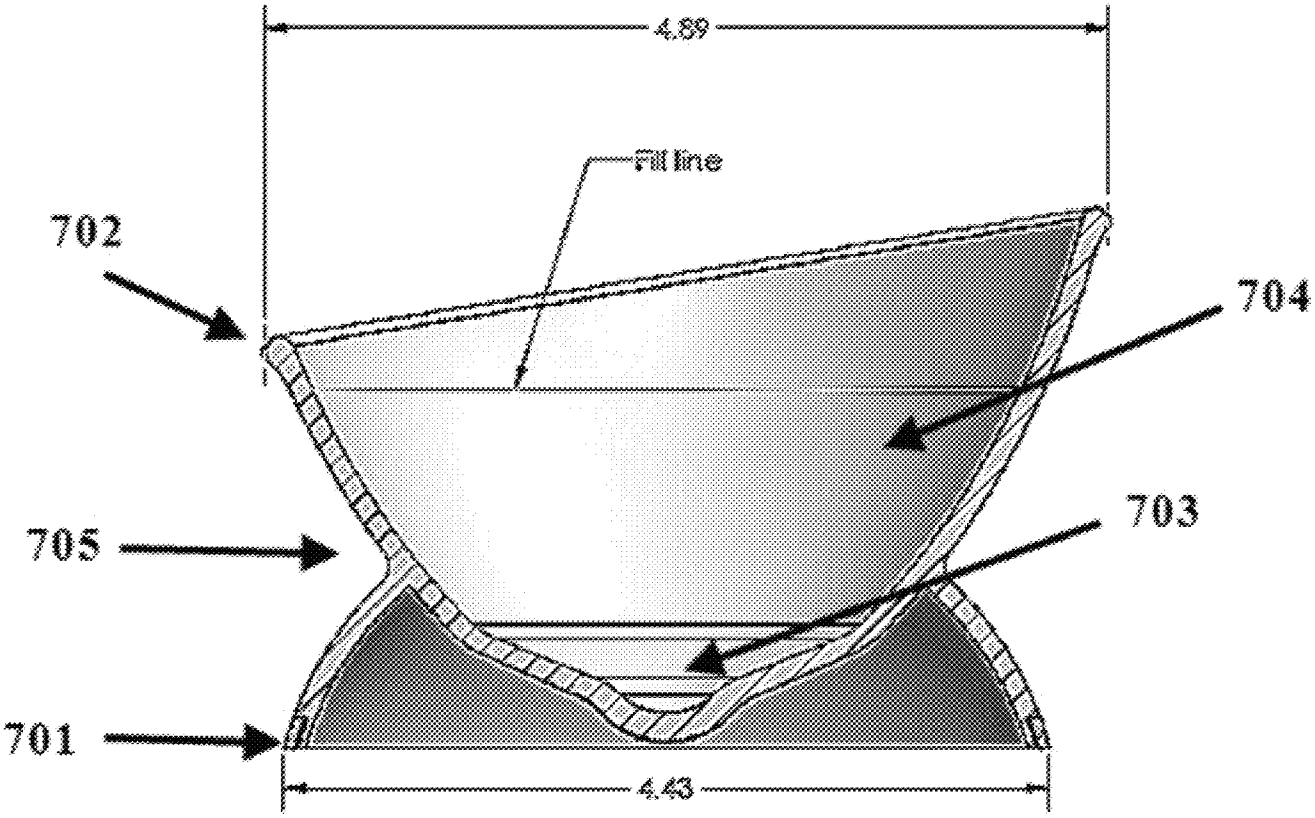
Figure 7D:
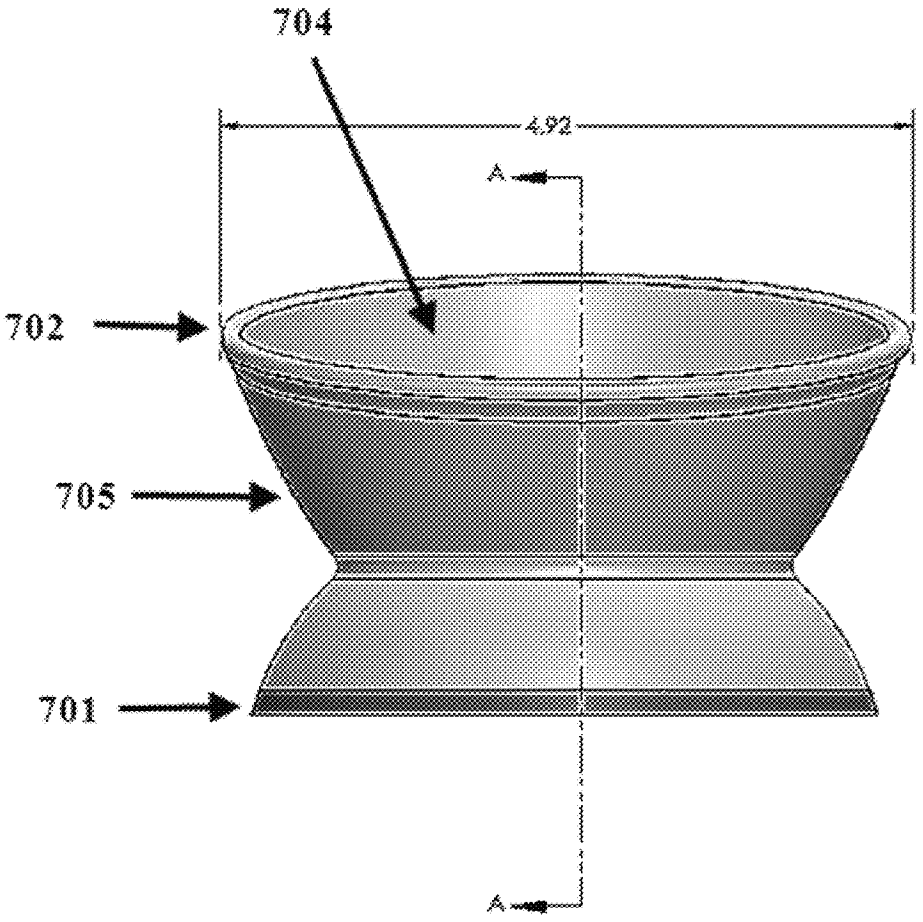

Referring to FIG. 7A-D, for example, the base 701 and the top edge 702 are not parallel. The largest dimension of the base 701 and the top edge 702 may be approximately the same. The interior wall 704 extends from the top edge 702 to the food collection area 703. The food collection area 703 may comprise a concave surface, as shown in FIG. 7C. The exterior wall 705 extends from the top edge 702 to the base 701. The exterior wall 705 has a range of external heights (e.g., about 2.37 inches to about 3.12 inches, as shown here). All units are in inches.

Figure 8A:
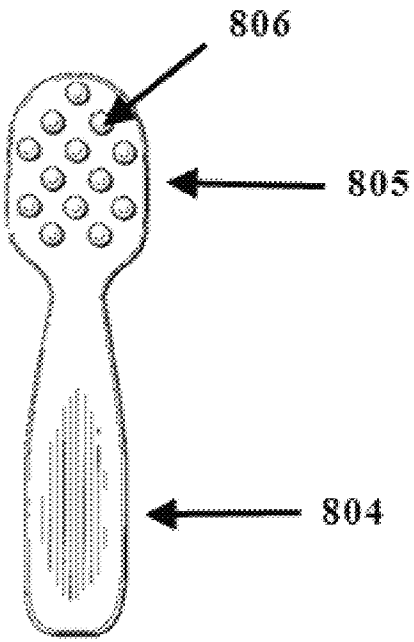
FIG. 8A-8C show representative images of a bowl as disclosed herein in combination with a utensil having a plurality of projections (FIG. 8A), a hole (FIG. 8B), or a plurality of depressions (FIG. 8C) in the food end.
Figure 8A:
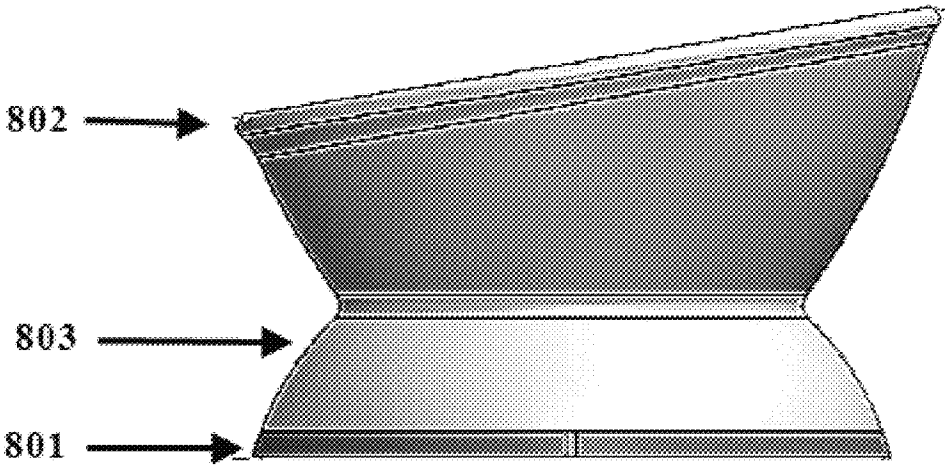
Figure 8B:
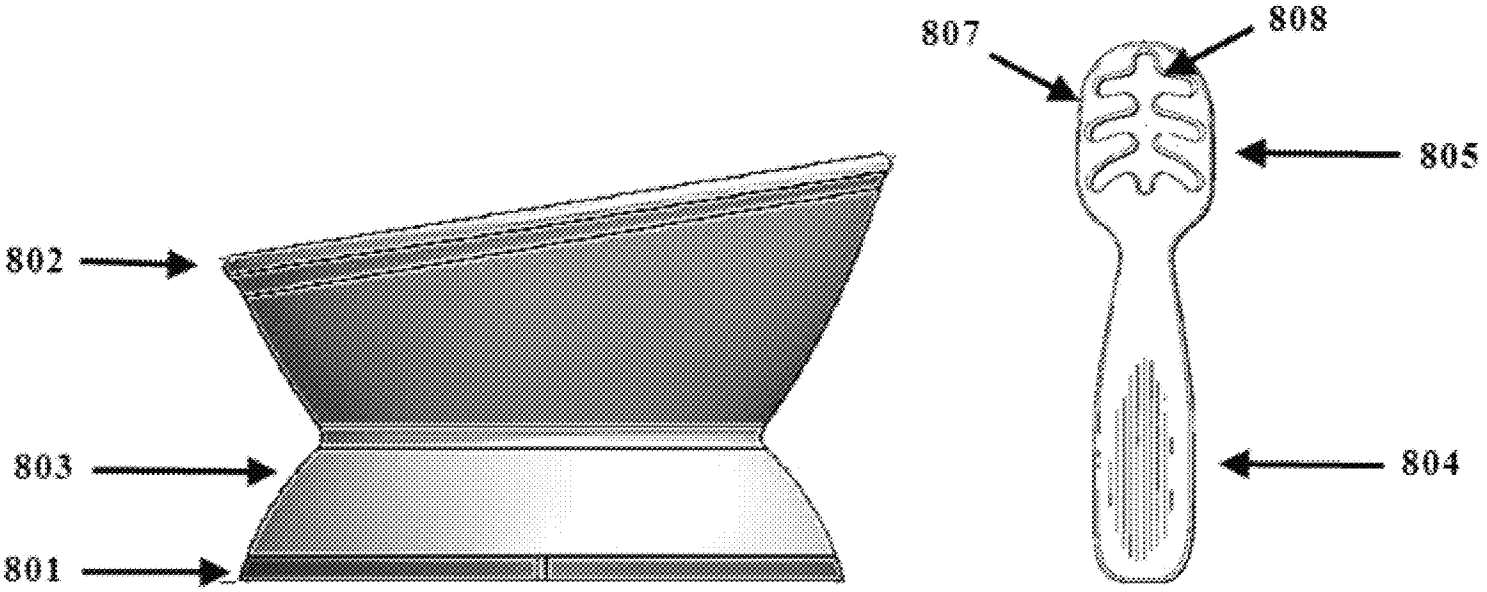
Figure 8C:
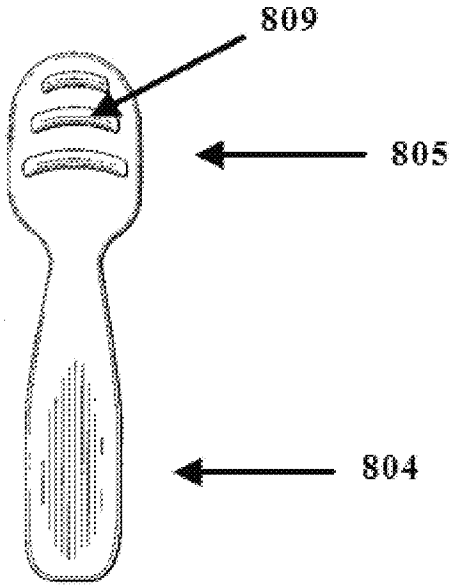
Figure 8C:
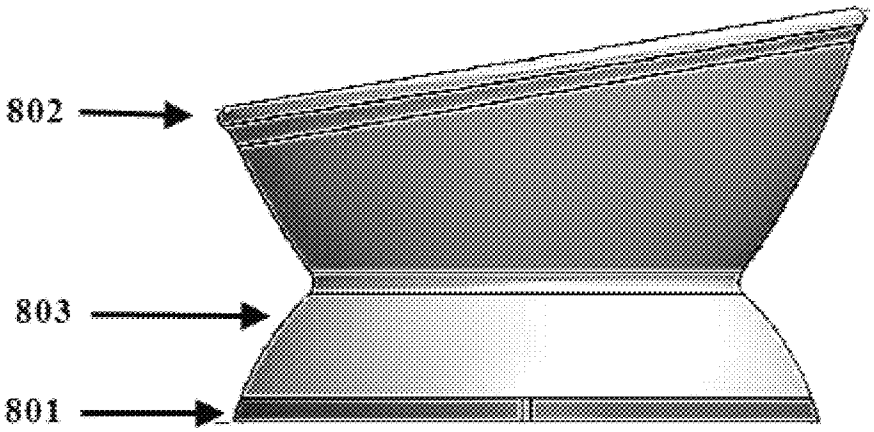

Referring to FIG. 8A-C, for example, the base 801 and the top edge 802 are not parallel. The largest dimension of the base 801 and the top edge 802 may be approximately the same. The largest dimension of the top edge 802 may be greater than that of the base 801. The exterior wall 803 extends from the top edge 802 to the base 801. An eating utensil, including handle end 804 and food end 805, may be used. The utensil may include protrusions 806. Alternatively, the utensil may include arms 807 extending into a hole, and interior edge 808 of a hole, and/or ridges 809.

Figure 9A:
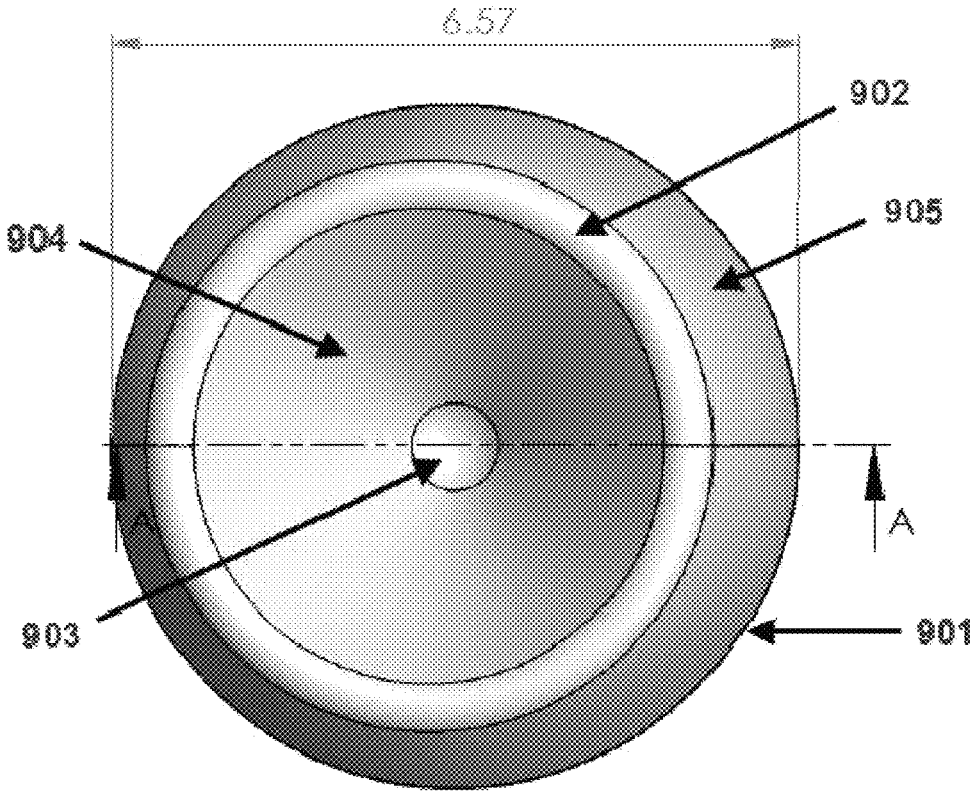
FIG. 9A-9C show representative images of a bowl as disclosed herein. A top view (FIG. 9A), side view (FIG. 9B), and cross-sectional view (FIG. 9C) taken in the plane of AA as shown in the top view are illustrated.
Figure 9B:
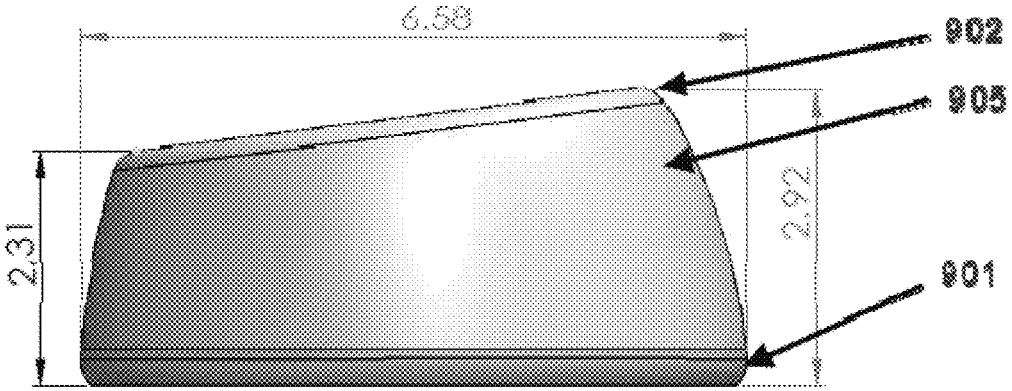
Figure 9C:
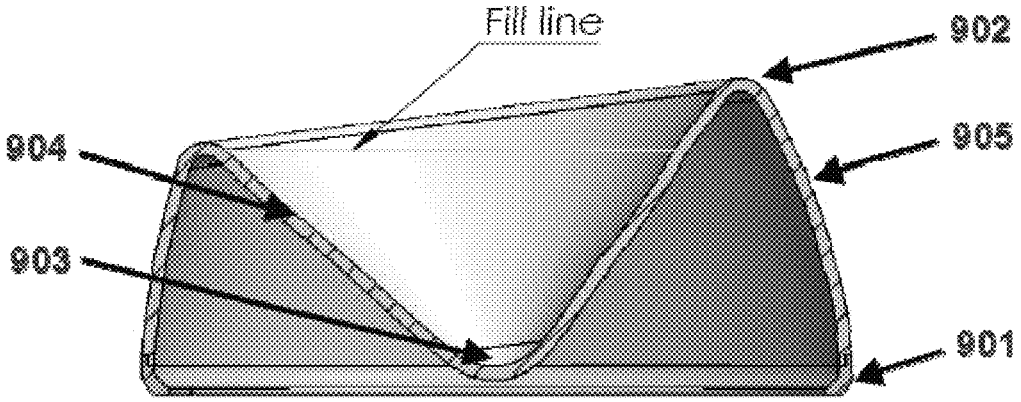

Referring to FIG. 9A-D, for example, the base 901 and the top edge 902 are not parallel. The largest dimension of the base 901 and the top edge 902 may be approximately the same. The largest dimension of the top edge 902 may be less than that of the base 901. The interior wall 904 extends from the top edge 902 to the food collection area 903. The food collection area 903 may comprise a concave surface, as shown in FIG. 9C. The exterior wall 905 extends from the top edge 902 to the base 901. The exterior wall 905 has a range of external heights (e.g., about 2.31 inches to about 2.92 inches, as shown here). All units are in inches.

In various aspects, the apparatus is a dish. Examples of dishes include, but are not limited to, a bowl, a basin, a porringer, a crock, a pot, a container, and a vessel. Thus, in a further aspect, the apparatus is a bowl.

In a further aspect, the apparatus has an external height of from about 1.0 inch to about 11.0 inches. In a still further aspect, the apparatus has an external height of from about 1.0 inch to about 10 inches. In yet a further aspect, the apparatus has an external height of from about 1.0 inch to about 9.0 inches. In an even further aspect, the apparatus has an external height of from about 1.0 inch to about 8.0 inches. In a still further aspect, the apparatus has an external height of from about 1.0 inch to about 7.0 inches. In yet a further aspect, the apparatus has an external height of from about 1.0 inch to about 6.0 inches. In an even further aspect, the apparatus has an external height of from about 1.0 inch to about 5.0 inches. In a still further aspect, the apparatus has an external height of from about 1.0 inch to about 4.0 inches. In yet a further aspect, the apparatus has an external height of from about 1.0 inch to about 3.5 inches. In a still further aspect, the apparatus has an external height of from about 1.0 inch to about 3.0 inches. In yet a further aspect, the apparatus has an external height of from about 2.0 inches to about 12.0 inches. In an even further aspect, the apparatus has an external height of from about 3.0 inches to about 12.0 inches. In a still further aspect, the apparatus has an external height of from about 4.0 inches to about 12.0 inches. In yet a further aspect, the apparatus has an external height of from about 5.0 inches to about 12.0 inches. In an even further aspect, the apparatus has an external height of from about 6.0 inches to about 12.0 inches. In a still further aspect, the apparatus has an external height of from about 7.0 inches to about 12.0 inches. In yet a further aspect, the apparatus has an external height of from about 8.0 inches to about 12.0 inches. In an even further aspect, the apparatus has an external height of from about 9.0 inches to about 12.0 inches. In a still further aspect, the apparatus has an external height of from about 10.0 inches to about 12.0 inches. In yet a further aspect, the apparatus has an external height of from about 11.0 inches to about 12.0 inches. In an even further aspect, the apparatus has an external height of from about 2.0 inches to about 11.0 inches. In a still further aspect, the apparatus has an external height of from about 2.0 inches to about 10.0 inches. In yet a further aspect, the apparatus has an external height of from about 2.0 inches to about 9.0 inches. In an even further aspect, the apparatus has an external height of from about 2.0 inches to about 8.0 inches. In a still further aspect, the apparatus has an external height of from about 2.0 inches to about 7.0 inches. In yet a further aspect, the apparatus has an external height of from about 2.0 inches to about 6.0 inches. In an even further aspect, the apparatus has an external height of from about 2.0 inches to about 5.0 inches. In a still further aspect, the apparatus has an external height of from about 2.0 inches to about 4.0 inches. In yet a further aspect, the apparatus has an external height of from about 2.0 inches to about 3.0 inches. In an even further aspect, the apparatus has an external height of from about 3.0 inches to about 4.0 inches.

In a further aspect, the apparatus has a uniform external height. In a still further aspect, the apparatus has a range of external heights.

In a further aspect, the apparatus has an internal height of from about 1.0 inch to about 5.0 inches. In a still further aspect, the apparatus has an internal height of from about 1.0 inch to about 4.5 inches. In yet a further aspect, the apparatus has an internal height of from about 1.0 inch to about 4.0 inches. In an even further aspect, the apparatus has an internal height of from about 1.0 inch to about 3.5 inches. In a still further aspect, the apparatus has an internal height of from about 1.0 inch to about 3.0 inches. In yet a further aspect, the apparatus has an internal height of from about 1.0 inch to about 2.5 inches. In an even further aspect, the apparatus has an internal height of from about 1.0 inch to about 2.0 inches. In a still further aspect, the apparatus has an internal height of from about 1.5 inches to about 5.0 inches. In yet a further aspect, the apparatus has an internal height of from about 2.0 inches to about 5.0 inches. In an even further aspect, the apparatus has an internal height of from about 2.5 inches to about 5.0 inches. In a still further aspect, the apparatus has an internal height of from about 3.0 inches to about 5.0 inches. In yet a further aspect, the apparatus has an internal height of from about 3.5 inches to about 5.0 inches. In an even further aspect, the apparatus has an internal height of from about 4.0 inches to about 5.0 inches. In a still further aspect, the apparatus has an internal height of from about 2.0 inches to about 4.5 inches. In yet a further aspect, the apparatus has an internal height of from about 2.0 inches to about 4.0 inches. In an even further aspect, the apparatus has an internal height of from about 2.0 inches to about 3.5 inches. In a still further aspect, the apparatus has an internal height of from about 2.0 inches to about 3.0 inches.

In a further aspect, the apparatus has a uniform internal height. In a still further aspect, the apparatus has a range of internal heights.

1. Base

In one aspect, the disclosed apparatus comprises a base having a largest dimension of from about 3.0 inches to about 12 inches.

The base can optionally comprise non-slip material. Non-slip material refers to material that reduces the likelihood of slippage, sliding, or movement of the apparatus. For example, the non-slip material may increase friction between the apparatus and a table, tray, high chair tray, or other surface. Thus, in various aspects, the base comprises a tacky material. In a further aspect, the base comprises a weighted material.

The base can define a variety of shapes. Exemplary shapes defined by the base include, but are not limited to, a circle, a square, a rectangle, an oval, an elliptical, a triangle, and a heart. In various aspects, the shape defined by the base mirrors the shape defined by the top edge. Alternatively, the shape defined by the base is different than the shape defined by the top edge.

In a further aspect, the largest dimension of the base is of from about 3.0 inches to about 11 inches. In a still further aspect, the largest dimension of the base is of from about 3.0 inches to about 10 inches. In yet a further aspect, the largest dimension of the base is of from about 3.0 inches to about 9.0 inches. In an even further aspect, the largest dimension of the base is of from about 3.0 inches to about 8.0 inches. In a still further aspect, the largest dimension of the base is of from about 3.0 inches to about 7.0 inches. In yet a further aspect, the largest dimension of the base is of from about 3.0 inches to about 6.0 inches. In an even further aspect, the largest dimension of the base is of from about 3.0 inches to about 5.0 inches. In a still further aspect, the largest dimension of the base is of from about 3.0 inches to about 4.0 inches. In yet a further aspect, the largest dimension of the base is of from about 4.0 inches to about 12 inches. In an even further aspect, the largest dimension of the base is of from about 5.0 inches to about 12 inches. In a still further aspect, the largest dimension of the base is of from about 6.0 inches to about 12 inches. In yet a further aspect, the largest dimension of the base is of from about 7.0 inches to about 12 inches. In an even further aspect, the largest dimension of the base is of from about 8.0 inches to about 12 inches. In a still further aspect, the largest dimension of the base is of from about 9.0 inches to about 12 inches. In yet a further aspect, the largest dimension of the base is of from about 10.0 inches to about 12 inches. In an even further aspect, the largest dimension of the base is of from about 10.0 inches to about 12 inches. In a still further aspect, the largest dimension of the base is of from about 4.0 inches to about 11 inches. In yet a further aspect, the largest dimension of the base is of from about 4.0 inches to about 10 inches. In an even further aspect, the largest dimension of the base is of from about 4.0 inches to about 9.0 inches. In a still further aspect, the largest dimension of the base is of from about 4.0 inches to about 8.0 inches. In yet a further aspect, the largest dimension of the base is of from about 4.0 inches to about 7.0 inches. In an even further aspect, the largest dimension of the base is of from about 4.0 inches to about 6.0 inches. In a still further aspect, the largest dimension of the base is of from about 4.0 inches to about 5.0 inches.

In a further aspect, the largest dimension of the base is approximately equal to the largest dimension of the top edge. In a still further aspect, the largest dimension of the base is greater than the largest dimension of the top edge. In yet a further aspect, the largest dimension of the base is less than the largest dimension of the top edge.

2. Top Edge

In one aspect, the apparatus comprises a top edge having a largest dimension of from about 3.0 inches to about 10 inches.

The top edge can define a variety of shapes. Exemplary shapes defined by the top edge include, but are not limited to, a circle, a square, a rectangle, an oval, an elliptical, a triangle, and a heart. In various aspects, the shape of the base mirrors the shape of the top edge. Alternatively, the shape of the base is different than the shape of the top edge.

In a further aspect, the largest dimension of the top edge is of from about 3.0 inches to about 9.0 inches. In a still further aspect, the largest dimension of the top edge is of from about 3.0 inches to about 8.0 inches. In yet a further aspect, the largest dimension of the top edge is of from about 3.0 inches to about 7.0 inches. In an even further aspect, the largest dimension of the top edge is of from about 3.0 inches to about 6.0 inches. In a still further aspect, the largest dimension of the top edge is of from about 3.0 inches to about 5.0 inches. In yet a further aspect, the largest dimension of the top edge is of from about 3.0 inches to about 4.0 inches. In an even further aspect, the largest dimension of the top edge is of from about 4.0 inches to about 10.0 inches. In a still further aspect, the largest dimension of the top edge is of from about 5.0 inches to about 10.0 inches. In yet a further aspect, the largest dimension of the top edge is of from about 6.0 inches to about 10.0 inches. In an even further aspect, the largest dimension of the top edge is of from about 7.0 inches to about 10.0 inches. In a still further aspect, the largest dimension of the top edge is of from about 8.0 inches to about 10.0 inches. In yet a further aspect, the largest dimension of the top edge is of from about 9.0 inches to about 10.0 inches. In an even further aspect, the largest dimension of the top edge is of from about 4.0 inches to about 9.0 inches. In a still further aspect, the largest dimension of the top edge is of from about 4.0 inches to about 8.0 inches. In yet a further aspect, the largest dimension of the top edge is of from about 4.0 inches to about 7.0 inches. In an even further aspect, the largest dimension of the top edge is of from about 4.0 inches to about 6.0 inches. In a still further aspect, the largest dimension of the top edge is of from about 5.0 inches to about 6.0 inches.

In a further aspect, the largest dimension of the top edge is approximately equal to the largest dimension of the base. In a still further aspect, the largest dimension of the top edge is greater than the largest dimension of the base. In yet a further aspect, the largest dimension of the top edge is less than the largest dimension of the base.

In a further aspect, the top edge has a thickness of less than about 2.0 inches. In a still further aspect, the top edge has a thickness of less than about 1.5 inches. In yet a further aspect, the top edge has a thickness of less than about 1.0 inches. In an even further aspect, the top edge has a thickness of less than about 0.5 inches. In a still further aspect, the top edge has a thickness of less than about 0.4 inches. In yet a further aspect, the top edge has a thickness of less than about 0.3 inches. In an even further aspect, the top edge has a thickness of less than about 0.2 inches. In a still further aspect, the top edge has a thickness of less than about 0.15 inches.

3. Food Collection Area

In one aspect, the apparatus comprises a food collection area having a largest dimension of less than about 2.5 inches.

In various aspects, the food collection area is a point. In a further aspect, the food collection area comprises a concave surface. In a still further aspect, the food collection area comprises a planar surface.

In a further aspect, the apparatus comprises a food collection area having a largest dimension of less than about 2.4 inches. In a still further aspect, the apparatus comprises a food collection area having a largest dimension of less than about 2.3 inches. In yet a further aspect, the apparatus comprises a food collection area having a largest dimension of less than about 2.2 inches. In an even further aspect, the apparatus comprises a food collection area having a largest dimension of less than about 2.1 inches. In a still further aspect, the apparatus comprises a food collection area having a largest dimension of less than about 2.0 inches. In yet a further aspect, the apparatus comprises a food collection area having a largest dimension of less than about 1.9 inches. In an even further aspect, the apparatus comprises a food collection area having a largest dimension of less than about 1.8 inches. In a still further aspect, the apparatus comprises a food collection area having a largest dimension of less than about 1.7 inches. In yet a further aspect, the apparatus comprises a food collection area having a largest dimension of less than about 1.6 inches. In an even further aspect, the apparatus comprises a food collection area having a largest dimension of less than about 1.5 inches.

4. Interior Wall

In one aspect, the apparatus comprises an interior wall that extends from the top edge to the food collection area at an angle of from about 10° to about 60°.

In a further aspect, the interior wall is straight. In a still further aspect, the interior wall is concave and the angle is calculated via a linear regression analysis. In yet a further aspect, the interior wall is convex and the angle is calculated via a linear regression analysis.

In an even further aspect, the interior wall extends from the top edge to the food collection area at an angle of from about 10° to about 55°. In a still further aspect, the interior wall extends from the top edge to the food collection area at an angle of from about 10° to about 50°. In yet a further aspect, the interior wall extends from the top edge to the food collection area at an angle of from about 10° to about 45°. In an even further aspect, the interior wall extends from the top edge to the food collection area at an angle of from about 10° to about 40°. In a still further aspect, the interior wall extends from the top edge to the food collection area at an angle of from about 10° to about 45°. In yet a further aspect, the interior wall extends from the top edge to the food collection area at an angle of from about 10° to about 40°. In an even further aspect, the interior wall extends from the top edge to the food collection area at an angle of from about 10° to about 35°. In a still further aspect, the interior wall extends from the top edge to the food collection area at an angle of from about 10° to about 30°. In yet a further aspect, the interior wall extends from the top edge to the food collection area at an angle of from about 15° to about 60°. In an even further aspect, the interior wall extends from the top edge to the food collection area at an angle of from about 20° to about 60°. In a still further aspect, the interior wall extends from the top edge to the food collection area at an angle of from about 25° to about 60°. In yet a further aspect, the interior wall extends from the top edge to the food collection area at an angle of from about 30° to about 60°. In an even further aspect, the interior wall extends from the top edge to the food collection area at an angle of from about 35° to about 60°. In a still further aspect, the interior wall extends from the top edge to the food collection area at an angle of from about 40° to about 60°. In yet a further aspect, the interior wall extends from the top edge to the food collection area at an angle of from about 45° to about 60°. In an even further aspect, the interior wall extends from the top edge to the food collection area at an angle of from about 50° to about 60°. In a still further aspect, the interior wall extends from the top edge to the food collection area at an angle of from about 15° to about 55°. In yet a further aspect, the interior wall extends from the top edge to the food collection area at an angle of from about 20° to about 50°. In an even further aspect, the interior wall extends from the top edge to the food collection area at an angle of from about 20° to about 45°. In a still further aspect, the interior wall extends from the top edge to the food collection area at an angle of from about 25° to about 45°. In yet a further aspect, the interior wall extends from the top edge to the food collection area at an angle of from about 25° to about 50°. In an even further aspect, the interior wall extends from the top edge to the food collection area at an angle of from about 30° to about 50°. In a still further aspect, the interior wall extends from the top edge to the food collection area at an angle of from about 30° to about 40°. In yet a further aspect, the interior wall extends from the top edge to the food collection area at an angle of from about 40° to about 50°.

In a further aspect, the interior wall extends from the top edge to the food collection area at a substantially uniform angle. In a still further aspect, the interior wall extends from the top edge to the food collection area at a range of different angles.

In a further aspect, at least a portion of the interior wall extends from the top edge to the food collection area at an angle of from about 15° to about 60°. In a still further aspect, at least a portion of the interior wall extends from the top edge to the food collection area at an angle of from about 20° to about 60°. In yet a further aspect, at least a portion of the interior wall extends from the top edge to the food collection area at an angle of from about 25° to about 60°. In an even further aspect, at least a portion of the interior wall extends from the top edge to the food collection area at an angle of from about 30° to about 60°. In a still further aspect, at least a portion of the interior wall extends from the top edge to the food collection area at an angle of from about 35° to about 60°. In yet a further aspect, at least a portion of the interior wall extends from the top edge to the food collection area at an angle of from about 40° to about 60°. In an even further aspect, at least a portion of the interior wall extends from the top edge to the food collection area at an angle of from about 45° to about 60°. In a still further aspect, at least a portion of the interior wall extends from the top edge to the food collection area at an angle of from about 15° to about 55°. In yet a further aspect, at least a portion of the interior wall extends from the top edge to the food collection area at an angle of from about 15° to about 50°. In an even further aspect, at least a portion of the interior wall extends from the top edge to the food collection area at an angle of from about 15° to about 45°. In a still further aspect, at least a portion of the interior wall extends from the top edge to the food collection area at an angle of from about 15° to about 40°. In yet a further aspect, at least a portion of the interior wall extends from the top edge to the food collection area at an angle of from about 20° to about 50°. In an even further aspect, at least a portion of the interior wall extends from the top edge to the food collection area at an angle of from about 25° to about 45°. In a still further aspect, at least a portion of the interior wall extends from the top edge to the food collection area at an angle of from about 25° to about 35°. In yet a further aspect, at least a portion of the interior wall extends from the top edge to the food collection area at an angle of from about 35° to about 45°. In an even further aspect, at least a portion of the interior wall extends from the top edge to the food collection area at an angle of from about 45° to about 55°.

5. Exterior Wall

In one aspect, the apparatus comprises an exterior wall that extends from the top edge to the base. In a further aspect, the exterior wall extends straight down from the top edge to the base. In a still further aspect, the exterior wall does not extend straight down from the top edge to the base.

6. Additional Elements

In various aspects, the apparatus can further comprise an additional element. Additional elements include, but are not limited to, a non-slip member, a handle, and a lid.

Thus, in a further aspect, the apparatus can further comprise a non-slip member. Examples of non-slip members include, but are not limited to, a suction cup and a magnetic material. In a still further aspect, the non-slip member is connected to the base.

In a further aspect, the apparatus can further comprise a handle.

In a further aspect, the apparatus can further comprise a lid.

C. Methods

In one aspect, disclosed are methods comprising: (a) providing an apparatus comprising: (i) a base having a largest dimension of from about 3.0 inches to about 12 inches; (ii) a top edge having a largest dimension of from about 3.0 inches to about 10 inches; (iii) a food collection area having a largest dimension of less than about 2.5 inches, wherein the food collection area contains food; (iv) an interior wall that extends from the top edge to the food collection area at an angle of from about 10° to about 60°; and (v) an exterior wall that extends from the top edge to the base, wherein the apparatus has an external height of from about 1.0 inch to about 12.0 inches, wherein the external height is the vertical distance between the top edge and the base, and wherein the apparatus has an internal height of from about 1.0 inch to about 3.5 inches, wherein the internal height is the vertical distance between the top edge and the food collection area; (b) providing a utensil comprising a handle end and a food end; (c) inserting the utensil into the food collection area, thereby getting food onto the food end; and (d) inserting the food end into a person's mouth, thereby transferring food from the food collection area into the person's mouth.

In a further aspect, the person has minimum fine motor skills. In a still further aspect, the person is an invalid. In yet a further aspect, the person has had a stroke. In an even further aspect, the person is a child, toddler, or infant.

In a further aspect, the utensil is selected from a spoon, a fork, a spork, and a knife. In a still further aspect, the utensil is selected from a spoon, a fork, and a spork. In yet a further aspect, the utensil is selected from a spoon and a fork. In an even further aspect, the utensil is a knife. In a still further aspect, the utensil is a spork. In yet a further aspect, the utensil is a fork. In an even further aspect, the utensil is a spoon.

In a further aspect, the utensil is of from about 3.0 inches to about 10.0 inches. In a still further aspect, the utensil is of from about 3.0 inches to about 9.0 inches. In yet a further aspect, the utensil is of from about 3.0 inches to about 8.0 inches. In an even further aspect, the utensil is of from about 3.0 inches to about 7.0 inches. In a still further aspect, the utensil is of from about 3.0 inches to about 6.0 inches. In yet a further aspect, the utensil is of from about 3.0 inches to about 5.0 inches. In an even further aspect, the utensil is of from about 3.0 inches to about 4.0 inches. In a still further aspect, the utensil is of from about 4.0 inches to about 10.0 inches. In yet a further aspect, the utensil is of from about 5.0 inches to about 10.0 inches. In an even further aspect, the utensil is of from about 6.0 inches to about 10.0 inches. In a still further aspect, the utensil is of from about 7.0 inches to about 10.0 inches. In yet a further aspect, the utensil is of from about 8.0 inches to about 10.0 inches. In an even further aspect, the utensil is of from about 4.0 inches to about 9.0 inches. In a still further aspect, the utensil is of from about 4.0 inches to about 8.5 inches. In yet a further aspect, the utensil is of from about 3.5 inches to about 4.5 inches. In an even further aspect, the utensil is of from about 8.0 inches to about 9.0 inches.

In a further aspect, the handle end and the food end comprise separate pieces. In a still further aspect, the handle end and food end comprise a single piece.

In a further aspect, the handle end is symmetric with respect to the longitudinal axis when viewed from the front. In a still further aspect, the food end is symmetric with respect to the longitudinal axis when viewed from the front. In yet a further aspect, the handle end and the food end are symmetric with respect to the longitudinal axis when viewed from the front.

In various aspects, the handle end has a length of from about 2.0 inches to about 5.0 inches. In a further aspect, the handle end has a length of from about 2.0 inches to about 4.0 inches. In a still further aspect, the handle end has a length of from about 2.0 inches to about 3.0 inches. In yet a further aspect, the handle end has a length of from about 3.0 inches to about 5.0 inches. In an even further aspect, the handle end has a length of from about 4.0 inches to about 5.0 inches. In a still further aspect, the handle end has a length of from about 2.5 inches to about 4.5 inches. In yet a further aspect, the handle end has a length of from about 2.5 inches to about 4.0 inches. In an even further aspect, the handle end has a length of from about 3.0 inches to about 4.0 inches.

In a further aspect, the food end is dimensioned to fit into a person's mouth. Thus, in various aspects, the food end has a width of from about 0.5 inches to about 2.0 inches. In a further aspect, the food end has a width of from about 0.5 inches to about 1.75 inches. In a still further aspect, the food end has a width of from about 0.5 inches to about 1.5 inches. In yet a further aspect, the food end has a width of from about 0.5 inches to about 1.25 inches. In an even further aspect, the food end has a width of from about 0.5 inches to about 1.0 inch. In a still further aspect, the food end has a width of from about 0.5 inches to about 0.75 inches. In yet a further aspect, the food end has a width of from about 0.75 inches to about 2.0 inches. In an even further aspect, the food end has a width of from about 1.0 inch to about 2.0 inches. In a still further aspect, the food end has a width of from about 1.25 inches to about 2.0 inches. In yet a further aspect, the food end has a width of from about 1.5 inches to about 2.0 inches. In an even further aspect, the food end has a width of from about 1.75 inches to about 2.0 inches. In a still further aspect, the food end has a width of from about 0.75 inches to about 1.75 inches. In yet a further aspect, the food end has a width of from about 1.0 inch to about 1.5 inches.

In various aspects, the food end has a length of from about 1.0 inch to about 3.0 inches. In a further aspect, the food end has a length of from about 1.0 inch to about 2.75 inches. In a still further aspect, the food end has a length of from about 1.0 inch to about 2.5 inches. In yet a further aspect, the food end has a length of from about 1.0 inch to about 2.0 inches. In an even further aspect, the food end has a length of from about 1.0 inch to about 1.75 inches. In a still further aspect, the food end has a length of from about 1.0 inch to about 1.5 inches. In yet a further aspect, the food end has a length of from about 1.0 inch to about 1.25 inches. In an even further aspect, the food end has a length of from about 1.25 inches to about 3.0 inches. In a still further aspect, the food end has a length of from about 1.5 inches to about 3.0 inches. In yet a further aspect, the food end has a length of from about 1.75 inches to about 3.0 inches. In an even further aspect, the food end has a length of from about 2.0 inches to about 3.0 inches. In a still further aspect, the food end has a length of from about 2.25 inches to about 3.0 inches. In yet a further aspect, the food end has a length of from about 2.5 inches to about 3.0 inches. In an even further aspect, the food end has a length of from about 2.75 inches to about 3.0 inches. In a still further aspect, the food end has a length of from about 1.25 inches to about 2.75 inches. In yet a further aspect, the food end has a length of from about 1.5 inches to about 2.5 inches. In an even further aspect, the food end has a length of from about 1.75 inches to about 2.5 inches.

In a further aspect, the food end comprises a flat surface having a first face and a second face. In a still further aspect, the food end comprises a concave surface having a first face and a second face. In yet a further aspect, the food end comprises prongs. In an even further aspect, the food end comprises a flat surface having a first face and a second face and prongs. In a still further aspect, the food end comprises a concave surface having a first face and a second face and prongs.

In a further aspect, the food end comprises an exterior edge and a food retaining edge, wherein the food retaining edge defines a hole, and the food end comprises a projection that extends out from the first or second face of the flat surface. In a still further aspect, the food end comprises a plurality of projections that extend out from the first and/or second face of the flat surface. In yet a further aspect, the projections are all on the same face of the flat surface. In an even further aspect, the projections are on both faces of the flat surface. In a still further aspect, the projection is a rounded element. In yet a further aspect, the projection is a ridge.

In a further aspect, the food end comprises an exterior edge and a food retaining edge, wherein the food retaining edge defines a hole, and the food end further comprises a depression that extends into the first or second face of the flat surface. In a still further aspect, the food end comprises a plurality of depressions that extend in to the first and/or second face of the flat surface. In yet a further aspect, the depressions are all on the same face of the flat surface. In an even further aspect, the depressions are on both faces of the flat surface.

In a further aspect, the food end comprises an exterior edge and a food retaining edge, wherein the food retaining edge defines a hole, and the food end comprises both a projection that extends out from the first or second face of the flat surface and a depression that extends into the first or second face of the flat surface. In a still further aspect, the food end comprises both a projection that extends out from the first or second face of the flat surface and a depression that extends into the first or second face of the flat surface.

In a further aspect, the food end comprises a projection that extends out from the first or second face of the flat surface. In a still further aspect, the food end comprises a plurality of projections that extend out from the first face and/or second face of the flat surface. In yet a further aspect, the projections are all on the same face of the flat surface. In an even further aspect, the projections are on both faces of the flat surface. Referring to FIG. 8A, the base 801 and the top edge 802 need not be parallel. The exterior wall 803 extends from the top edge 802 to the base 801. The utensil comprises a handle end 804 and a food end 805. The food end 805 comprises a flat surface. A plurality of projections 806 may extend out from the flat surface of the food end 805, as shown in FIG. 8A, or a single projection may extend out from the flat surface of the food end. The projection(s) may be round, as shown in FIG. 8A, but other shapes (e.g., square, oval, rectangular, heart-shaped, etc.) and sizes (e.g., narrower, wider, longer, shorter, larger, smaller, etc.) are also envisioned. Both the handle end and the food end are symmetrical with respect to the longitudinal axis when viewed from the front, as shown in FIG. 8A.

In a further aspect, the food end comprises an exterior edge and a food retaining edge, wherein the food retaining edge defines a hole. In a still further aspect, the food retaining edge defines arms that extend into the hole. Referring to FIG. 8B, the base 801 and the top edge 802 need not be parallel. The exterior wall 803 extends from the top edge 802 to the base 801. The utensil comprises a handle end 804 and a food end 805. The food end 805 comprises a flat surface. The food end 805 further comprises an exterior edge 807 and a food retaining edge 808. The food retaining edge 808 defines a hole. The food end may comprise a single food retaining edge 808 that defines a hole, as shown in FIG. 8B, or may comprise a plurality of food retaining edges that define multiple holes. The food retaining edge 808 may further define arms that extend into the hole, as shown in FIG. 8B. The food retaining edge(s) may be define a variety of different shapes and/or images including, but not limited to, a circle, an oval, a square, a rectangle, a triangle, a heart, an animal, or a letter, but other shapes are also envisioned. Both the handle end and the food end are symmetrical with respect to the longitudinal axis when viewed from the front, as shown in FIG. 8B.

In a further aspect, the food end comprises a depression that extends into the first or second face of the flat surface. In a still further aspect, the food end comprises a plurality of depressions that extend into the first and/or second face of the flat surface. In yet a further aspect, the depressions are all on the same face of the flat surface. In an even further aspect, the depressions are on both faces of the flat surface. Referring to FIG. 8C, the base 801 and the top edge 802 need not be parallel. The exterior wall 803 extends from the top edge 802 to the base 801. The utensil comprises a handle end 804 and a food end 805. The food end 805 may comprise a plurality of depressions 809 that extend into the flat surface, as shown in FIG. 8C, or a single depression that extends into the flat surface of the food end. The depression(s) may be long and curved, as shown in FIG. 8C, but other sizes (e.g., narrower, wider, longer, shorter, larger, smaller, etc.) and shapes (e.g., straight, circle, square, oval, rectangular, heart-shaped, etc.) are also envisioned. Both the handle end and the food end are symmetrical with respect to the longitudinal axis when viewed from the front, as shown in FIG. 8C.

D. Kits

In one aspect, disclosed are kits comprising an apparatus comprising: (a) a base having a largest dimension of from about 3.0 inches to about 12 inches; (b) a top edge having a largest dimension of from about 3.0 inches to about 10 inches; (c) a food collection area having a largest dimension of less than about 2.5 inches; (d) an interior wall that extends from the top edge to the food collection area at an angle of from about 10° to about 60°; and (e) an exterior wall that extends from the top edge to the base, wherein the apparatus has an external height of from about 1.0 inch to about 12.0 inches, wherein the external height is the vertical distance between the top edge and the base, and wherein the apparatus has an internal height of from about 1.0 inch to about 3.5 inches, wherein the internal height is the vertical distance between the top edge and the food collection area, and one or more of: (a) a utensil comprising a handle end and a food end; and (b) a lid.

In a further aspect, the kit further comprises a second utensil comprising a handle end and a food end. In a still further aspect, the kit further comprises a third utensil comprising a handle end and a food.

In a further aspect, the utensil is selected from a spoon, a fork, a spork, and a knife. In a still further aspect, the utensil is selected from a spoon, a fork, and a spork. In yet a further aspect, the utensil is selected from a spoon and a fork. In an even further aspect, the utensil is a knife. In a still further aspect, the utensil is a spork. In yet a further aspect, the utensil is a fork. In an even further aspect, the utensil is a spoon.

In a further aspect, the utensil is of from about 3.0 inches to about 10.0 inches. In a still further aspect, the utensil is of from about 3.0 inches to about 9.0 inches. In yet a further aspect, the utensil is of from about 3.0 inches to about 8.0 inches. In an even further aspect, the utensil is of from about 3.0 inches to about 7.0 inches. In a still further aspect, the utensil is of from about 3.0 inches to about 6.0 inches. In yet a further aspect, the utensil is of from about 3.0 inches to about 5.0 inches. In an even further aspect, the utensil is of from about 3.0 inches to about 4.0 inches. In a still further aspect, the utensil is of from about 4.0 inches to about 10.0 inches. In yet a further aspect, the utensil is of from about 5.0 inches to about 10.0 inches. In an even further aspect, the utensil is of from about 6.0 inches to about 10.0 inches. In a still further aspect, the utensil is of from about 7.0 inches to about 10.0 inches. In yet a further aspect, the utensil is of from about 8.0 inches to about 10.0 inches. In an even further aspect, the utensil is of from about 4.0 inches to about 9.0 inches. In a still further aspect, the utensil is of from about 4.0 inches to about 8.5 inches. In yet a further aspect, the utensil is of from about 3.5 inches to about 4.5 inches. In an even further aspect, the utensil is of from about 8.0 inches to about 9.0 inches.

In a further aspect, the handle end and the food end comprise separate pieces. In a still further aspect, the handle end and food end comprise a single piece.

In a further aspect, the handle end is symmetric with respect to the longitudinal axis when viewed from the front. In a still further aspect, the food end is symmetric with respect to the longitudinal axis when viewed from the front. In yet a further aspect, the handle end and the food end are symmetric with respect to the longitudinal axis when viewed from the front.

In various aspects, the handle end has a length of from about 2.0 inches to about 5.0 inches. In a further aspect, the handle end has a length of from about 2.0 inches to about 4.0 inches. In a still further aspect, the handle end has a length of from about 2.0 inches to about 3.0 inches. In yet a further aspect, the handle end has a length of from about 3.0 inches to about 5.0 inches. In an even further aspect, the handle end has a length of from about 4.0 inches to about 5.0 inches. In a still further aspect, the handle end has a length of from about 2.5 inches to about 4.5 inches. In yet a further aspect, the handle end has a length of from about 2.5 inches to about 4.0 inches. In an even further aspect, the handle end has a length of from about 3.0 inches to about 4.0 inches.

In a further aspect, the food end is dimensioned to fit into a person's mouth. Thus, in various aspects, the food end has a width of from about 0.5 inches to about 2.0 inches. In a further aspect, the food end has a width of from about 0.5 inches to about 1.75 inches. In a still further aspect, the food end has a width of from about 0.5 inches to about 1.5 inches. In yet a further aspect, the food end has a width of from about 0.5 inches to about 1.25 inches. In an even further aspect, the food end has a width of from about 0.5 inches to about 1.0 inch. In a still further aspect, the food end has a width of from about 0.5 inches to about 0.75 inches. In yet a further aspect, the food end has a width of from about 0.75 inches to about 2.0 inches. In an even further aspect, the food end has a width of from about 1.0 inch to about 2.0 inches. In a still further aspect, the food end has a width of from about 1.25 inches to about 2.0 inches. In yet a further aspect, the food end has a width of from about 1.5 inches to about 2.0 inches. In an even further aspect, the food end has a width of from about 1.75 inches to about 2.0 inches. In a still further aspect, the food end has a width of from about 0.75 inches to about 1.75 inches. In yet a further aspect, the food end has a width of from about 1.0 inch to about 1.5 inches.

In various aspects, the food end has a length of from about 1.0 inch to about 3.0 inches. In a further aspect, the food end has a length of from about 1.0 inch to about 2.75 inches. In a still further aspect, the food end has a length of from about 1.0 inch to about 2.5 inches. In yet a further aspect, the food end has a length of from about 1.0 inch to about 2.0 inches. In an even further aspect, the food end has a length of from about 1.0 inch to about 1.75 inches. In a still further aspect, the food end has a length of from about 1.0 inch to about 1.5 inches. In yet a further aspect, the food end has a length of from about 1.0 inch to about 1.25 inches. In an even further aspect, the food end has a length of from about 1.25 inches to about 3.0 inches. In a still further aspect, the food end has a length of from about 1.5 inches to about 3.0 inches. In yet a further aspect, the food end has a length of from about 1.75 inches to about 3.0 inches. In an even further aspect, the food end has a length of from about 2.0 inches to about 3.0 inches. In a still further aspect, the food end has a length of from about 2.25 inches to about 3.0 inches. In yet a further aspect, the food end has a length of from about 2.5 inches to about 3.0 inches. In an even further aspect, the food end has a length of from about 2.75 inches to about 3.0 inches. In a still further aspect, the food end has a length of from about 1.25 inches to about 2.75 inches. In yet a further aspect, the food end has a length of from about 1.5 inches to about 2.5 inches. In an even further aspect, the food end has a length of from about 1.75 inches to about 2.5 inches.

In a further aspect, the food end comprises an exterior edge and a food retaining edge, wherein the food retaining edge defines a hole. In a still further aspect, the food retaining edge defines arms that extend into the hole.

In a further aspect, the food end comprises a flat surface having a first face and a second face. In a still further aspect, the food end comprises a concave surface having a first face and a second face. In yet a further aspect, the food end comprises prongs. In an even further aspect, the food end comprises a flat surface having a first face and a second face and prongs. In a still further aspect, the food end comprises a concave surface having a first face and a second face and prongs.

In a further aspect, the food end comprises an exterior edge and a food retaining edge, wherein the food retaining edge defines a hole, and the food end comprises a projection that extends out from the first or second face of the flat surface. In a still further aspect, the food end comprises a plurality of projections that extend out from the first and/or second face of the flat surface. In yet a further aspect, the projections are all on the same face of the flat surface. In an even further aspect, the projections are on both faces of the flat surface. In a still further aspect, the projection is a rounded element. In yet a further aspect, the projection is a ridge.

In a further aspect, the food end comprises an exterior edge and a food retaining edge, wherein the food retaining edge defines a hole, and the food end further comprises a depression that extends into the first or second face of the flat surface. In a still further aspect, the food end comprises a plurality of depressions that extend in to the first and/or second face of the flat surface. In yet a further aspect, the depressions are all on the same face of the flat surface. In an even further aspect, the depressions are on both faces of the flat surface.

In a further aspect, the food end comprises an exterior edge and a food retaining edge, wherein the food retaining edge defines a hole, and the food end comprises both a projection that extends out from the first or second face of the flat surface and a depression that extends into the first or second face of the flat surface. In a still further aspect, the food end comprises both a projection that extends out from the first or second face of the flat surface and a depression that extends into the first or second face of the flat surface.

In a further aspect, the food end comprises a projection that extends out from the first or second face of the flat surface. In a still further aspect, the food end comprises a plurality of projections that extend out from the first face and/or second face of the flat surface. In yet a further aspect, the projections are all on the same face of the flat surface. In an even further aspect, the projections are on both faces of the flat surface.

In a further aspect, the food end comprises a depression that extends into the first or second face of the flat surface. In a still further aspect, the food end comprises a plurality of depressions that extend into the first and/or second face of the flat surface. In yet a further aspect, the depressions are all on the same face of the flat surface. In an even further aspect, the depressions are on both faces of the flat surface.

It will be apparent to those skilled in the art that various modifications and variations can be made in the present invention without departing from the scope or spirit of the invention. Other aspects of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus comprising:

a) a base having a largest dimension of from 3.0 inches to 12 inches;

b) a top edge having a largest dimension of from 3.0 inches to 10 inches;

c) a food collection area having a largest dimension of less than 2.5 inches;

d) an interior wall that extends from the top edge to the food collection area, wherein the entirety of the interior wall extends at an angle of from 10° to 60°; and e) an exterior wall that extends from the top edge to the base, wherein the apparatus has an external height of from 1.0 inch to 12.0 inches, wherein the external height is the vertical distance between the top edge and the base, and wherein the apparatus has an internal height of from 1.0 inch to 3.5 inches, wherein the internal height is the vertical distance between the top edge and the food collection area.

2. The apparatus of claim 1, wherein the largest dimension of the base is of from 4.0 inches to 6.0 inches.

3. The apparatus of claim 1, wherein the largest dimension of the top edge is of from 4.0 inches to 6.0 inches.

4. The apparatus of claim 1, wherein the food collection area has a largest dimension of less than 2.0 inches.

5. The apparatus of claim 1, wherein the food collection area is a point.

6. The apparatus of claim 1, wherein the food collection area comprises a concave surface.

7. The apparatus of claim 1, wherein the food collection area comprises a planar surface.

8. The apparatus of claim 1, wherein the interior wall is straight.

9. The apparatus of claim 1, wherein the entirety of the interior wall extends from the top edge to the food collection area at an angle of from 20° to 45°.

10. The apparatus of claim 1, wherein the entirety of the interior wall extends from the top edge to the food collection area at a substantially uniform angle.

11. The apparatus of claim 1, wherein the entirety of the interior wall extends from the top edge to the food collection area at a range of different angles.

12. The apparatus of claim 1, wherein the apparatus has an external height of from 2.0 inches to 3.0 inches.

13. The apparatus of claim 1, wherein the apparatus has a range of external heights.

14. The apparatus of claim 1, wherein the apparatus has an internal height of from 2.0 inches to 3.0 inches.

15. An apparatus comprising:

a) a base having a largest dimension of from 4.0 inches to 6.0 inches;

b) a top edge having a largest dimension of from 4.0 inches to 6.0 inches;

c) a food collection area having a largest dimension of less than about 2.0 inches;

d) a straight interior wall that extends from the top edge to the food collection area, wherein the entirety of the interior wall extends at an angle of from 20° to 45°; and e) an exterior wall that extends from the top edge to the base, wherein the apparatus has an external height of from 1.5 inches to 3.5 inches, wherein the external height is the vertical distance between the top edge and the base, and wherein the apparatus has an internal height of from 1.0 inch to 3.5 inches, wherein the internal height is the vertical distance between the top edge and the food collection area.

16. The apparatus of claim 15, wherein the entirety of the interior wall is straight.

17. An apparatus comprising:

a) a base having a largest dimension of from 3.0 inches to 12 inches;

b) a top edge having a largest dimension of from 3.0 inches to 10 inches;

c) a food collection area having a largest dimension of less than 2.0 inches;

d) a straight interior wall and an interior wall that extends at an angle of from 10° to 60°; and e) an exterior wall that extends from the top edge to the base, wherein the apparatus has an external height of from 1.0 inch to 12.0 inches, wherein the external height is the vertical distance between the top edge and the base, and wherein the apparatus has an internal height of from 1.0 inch to 3.5 inches, wherein the internal height is the vertical distance between the top edge and the food collection area.

18. The apparatus of claim 17, wherein the interior wall extends at a range of different angles.

19. The apparatus of claim 17, wherein the straight interior wall extends from the top edge to the food collection area.

20. The apparatus of claim 1, wherein the food collection area has a largest dimension of less than about 2.0 inches and wherein the apparatus has an internal height of from 2.0 inches to 3.5 inches.

* * * * *